US012123149B2

(12) United States Patent
Horton

(10) Patent No.: US 12,123,149 B2
(45) Date of Patent: Oct. 22, 2024

(54) GEOENGINEERING CONSTRUCTIONS FOR USE IN RAILWAYS

(71) Applicant: Tensar Technologies Limited, Blackburn (GB)

(72) Inventor: Mike Horton, Dunblane (GB)

(73) Assignee: TENSAR TECHNOLOGIES LIMITED, Blackburn (GB)

( * ) Notice: Subject to any disclaimer, the term of this patent is extended or adjusted under 35 U.S.C. 154(b) by 1091 days.

(21) Appl. No.: 16/647,143

(22) PCT Filed: Sep. 14, 2018

(86) PCT No.: PCT/GB2018/052629
§ 371 (c)(1),
(2) Date: Mar. 13, 2020

(87) PCT Pub. No.: WO2019/053454
PCT Pub. Date: Mar. 21, 2019

(65) Prior Publication Data

US 2021/0180262 A1 Jun. 17, 2021

(30) Foreign Application Priority Data

Sep. 15, 2017 (GB) ..... 1714867

(51) Int. Cl.
*E01B 1/00* (2006.01)
*E01B 2/00* (2006.01)
(Continued)

(52) U.S. Cl.
CPC ..... *E01B 26/00* (2013.01); *E01B 1/001* (2013.01); *E01B 2/006* (2013.01); *E01B 27/02* (2013.01)

(58) Field of Classification Search
CPC ..... E01B 26/00; E01B 1/001; E01B 2/006; E01B 27/02
See application file for complete search history.

(56) References Cited

U.S. PATENT DOCUMENTS 4,374,798 A 2/1983 Mercer
9,869,065 B2 * 1/2018 Haydu ..... E01B 1/001
(Continued)

FOREIGN PATENT DOCUMENTS

CN 101153475 4/2008
CN 201095717 8/2008
(Continued)

OTHER PUBLICATIONS

Tensar; Tensar SS Geogrid Product Specifications; All; 2015-2019 (Year: 2019).*

(Continued)

*Primary Examiner* — Benjamin F Fiorello
(74) *Attorney, Agent, or Firm* — Jacobson Holman PLLC

(57) ABSTRACT

A railway geogrid construction is suitable for use with high speed trains to mitigate the increased impact of Rayleigh waves generated at high speed and/or over soft subgrades. The construction includes a track bed which defines a track located on a track plane, a mass of particulate material such as an aggregate forming a layer located beneath the track plane, and a geogrid located in and/or below the particulate mass in a geogrid plane substantially parallel to the track plane where the average distance between the track plane and geogrid plane, measured perpendicular to both, is greater than 0.65 metres.

19 Claims, 7 Drawing Sheets

(Comp C and Examples 1 to 4)

(51) Int. Cl.
*E01B 26/00* (2006.01)
*E01B 27/02* (2006.01)

(56) References Cited

U.S. PATENT DOCUMENTS

| | | | | |
|---|---|---|---|---|
| 2006/0016635 | A1* | 1/2006 | Downey | B32B 3/30 181/290 |
| 2008/0116290 | A1* | 5/2008 | Freudenstein | E01B 1/004 238/2 |
| 2012/0305663 | A1* | 12/2012 | Axton | E01B 2/00 238/29 |
| 2013/0216773 | A1 | 8/2013 | Walsh | |
| 2015/0345084 | A1* | 12/2015 | Dehmel | E01B 27/11 238/2 |

FOREIGN PATENT DOCUMENTS

| | | |
|---|---|---|
| CN | 101979766 | 2/2011 |
| CN | 104631220 | 5/2015 |
| CN | 106555368 | 4/2017 |
| DE | 19755602 | 6/1998 |
| EP | 0374365 | 8/1989 |
| EP | 0515233 | 11/1992 |
| GB | 2035191 | 6/1980 |
| GB | 2243108 | 10/1991 |
| GB | 2503941 | 1/2014 |
| JP | H06-182897 | 7/1994 |
| JP | 2000352055 | 12/2000 |
| JP | 3233695 | 11/2001 |
| KR | 20050060991 | 6/2005 |
| RU | 2004302 | 12/1993 |
| RU | 79 107 | 12/2008 |
| WO | WO 98/15693 | 4/1998 |
| WO | WO2004/003303 | 1/2004 |
| WO | WO2004/079094 | 9/2004 |
| WO | WO2013061049 | 5/2013 |
| WO | WO 19/053454 | 9/2017 |
| WO | 3682059 A0 | 7/2020 |

OTHER PUBLICATIONS

Mezher et al.; Railway critical velocity—Analytical prediction and analysis; all; 2015 (Year: 2015).*

Guler, Erol et al.; Evaluation of the Geosynthetic Reinforcement on Railroad Subgrade; Procedia Engineering, Transportation Geotechnics and Geoecology; May 17-19, 2017; pp. 721-728; 189; Saint Petersburg, Russia.

Krylov, V V et al.; Rail movement and ground waves caused by highspeed trains approaching track-soil critical velocities; Proc Instn Mech Engrs; 2000; pp. 107-116; vol. 214 Part F.

Das, B. M. et al.; Use of Geogrids in Subgrade-Ballast System of Railroads Subjected to Cyclic Loading for Reducing Maintenance; California State University, 2013.

GSS undertakes geogrid trials for Tensar; Feb. 15, 2017; www.groundstiffnesssurveys.com/news/209-gss-undertakes-geogrid-trials-for-tensar?tmpl.

House of Commons Transport Committee; High Speed Rail; Nov. 8, 2011; pp. 140-143; vol. II; The Stationery Office Limited; London.

Ground Stiffness News; GSS Newsletter; Summer 2017; Issue 3; p. 2.

Woodward et al. Application of polyurethane geocomposites to help maintain track geometry for high-speed ballasted railway tracks. Journal of Zhejiang University Science A; vol. 13, No. 11, Nov. 8, 2012, pp. 836-849, XP035140278.

Japanese Office Action (with English language translation) dated Jul. 19, 2022.

* cited by examiner

FIGURE 1 (Comp A)

FIGURE 2 (Comp B)

FIGURE 3 (Comp C and Examples 1 to 4)

GEOENGINEERING CONSTRUCTIONS FOR USE IN RAILWAYS

BACKGROUND OF THE INVENTION

1. Field of the Invention

The present invention relates to use of geogrids that comprise polymeric materials in the form of mesh structures, in which the polymers are molecularly oriented to provide desired characteristics (such as strength and/or stiffness) to the geogrid to stabilize layers of particulate materials for example aggregate, soil and/or ballast (and the like) for railway track foundations. The invention also relates to geoengineering constructions such as railway track foundations so stabilized with geogrids, the constructions being especially particularly suited as a base onto which tracks may be laid that are designed for use by trains operated at high speed.

2. Description of Related Art

Geogrids have been used to stabilize the track beds for railways since the 1980s. A recent review article of railway geogrid use is "*Use of Geogrid in Subgrade Ballast Systems of Railroads Subjected to Cyclic Loading for Reducing Maintenance*", B M Das, California State University, 2013 (referred to herein as "Das"). Das provides a useful summary of the current state of the art in this field confirming that geogrids are currently used in two different ways to support railway track beds.

Firstly a geogrid can mechanically stabilize the ballast layer (and/or other particulate layer(s)) located immediately below and adjacent the track rails, which reduces ballast deformation due to tendency of the ballast to settle. This allows both vertical and horizontal alignment of the rails to be maintained for longer reducing the frequency between routine maintenance of the track. Secondly geogrids are used to reinforce and stabilize the sub ballast layer that supports the track bed to increases the load bearing capacity of the bed, especially when the bed is laid over soft sub grade materials. This also can reduce the thickness of the sub-ballast layer needed for a given track providing savings in capital and environmental cost.

Whether geogrids are used in railway applications to stabilize the ballast, sub ballast and/or other particulate layer(s), the geogrids are positioned at relatively shallow depths with respect to the track bed. This is confirmed by Das (see section 3.1) which describes studies that state that for the least amount of deformation under axle loads, the optimum value of the depth of the geogrid below the bottom of a track sleeper (this depth denoted Dr) should be from 50 to 100 mm. For other practical reasons, mostly related to the need to protect the geogrid and minimise maintenance, locating the geogrid slightly deeper at 200 mm, outside this optimum range, was found to be an acceptable compromise. This is an implicit teaching that the support from the geogrid will become less effective at greater depths as well as being more costly to construct. Das cites further studies (see section 3.2) describing railway tracks with the geogrid at depths (Dr) of 250 mm and 200 mm which confirms the typical depths used in practise. Section 6 of Das refers to Network Rail 2005 guidelines for calculating the depth of geogrids in the ballast and provides Figure 30 a plot showing the depth of sub-grade layer that must be provided below the sleeper base (for sub grade materials of different moduli) to satisfy a pre-set minimum value of stiffness required to support the sleeper. One of these plots is of a subgrade stiffened by geogrids (for K=30 kN/mm/sleeper end) where the maximum depth at the extreme end of the plot is just over 0.6 m. Das concludes (section 7) that "the minimum practical depth below ties at which geogrid reinforcement layer can be placed is about 200 mm. At this depth, the reinforcement benefits are still very significant". This is a further teaching that this "minimum" depth is selected as a compromise for practical reasons defined by other considerations and was not selected for maximum stabilization from the geogrid.

Das also refers to use of geogrids to support high speed tracks (see section 3.3) for example for a Korean HST which ran at 385 kph (about 105 $ms^{-1}$ or about 240 mph). However there is no suggestion that geogrids should be used any differently for high speed tracks compared to conventional tracks. An even more recent paper by Gulera et al is Procedia Engineering 189 (2017) 721-728, delivered at Transportation Geotechnics and Geoecology, TGG 2017, 17-19 May 2017, Saint Petersburg, Russia, entitled "Evaluation of the Geosynthetic Reinforcement on Railroad Subgrade". Gulera specifically evaluated geogrids for use with high speed rail train tracks. There is no teaching in Gulera to suggest that geogrids should be used other than in the known conventional manner for railways. Indeed Gulera teaches that the depth of the geogrid is 200 mm below the track ties, the same as described in Das for conventional tracks. Neither Gulera nor Das specifically refer to the specific issues faced by tracks for high speed trains that are described below.

The common general knowledge in this field (e.g. as shown by Das and Gulera) is that a skilled person would be motivated to place a geogrid no deeper under a railway track bed than needed, with the maximum effective depth being about 0.6 m in an extreme case, with depths of 200 to 250 mm being strongly preferred. Indeed by using geogrids to mechanically stabilize a sub ballast layer the layer thickness can be reduced by about a third compared to an unreinforced sub ballast layer. This further teaches a skilled person away from using geogrids to support railway tracks at much greater depths as this would require costly deep excavation of the ground and remove an important advantage of using geogrids. Thus there is a current and ongoing technical prejudice against using deeply buried geogrids for railways tracks whether the track is designed for use with high speed trains or for conventional trains.

P (primary, pressure or 'push') waves and S (secondary or shear) waves are the two types of elastic wave that travel through the body of a continuum. P-waves are formed from alternating compressions and rarefactions in the direction or prorogation through the continuum. S-waves move as a shear or transverse wave where motion in the continuum is perpendicular to the direction of wave propagation. P-waves have the higher velocity and therefore are recorded before S-waves.

It has recently been found there are additional problems faced by tracks designed for use with high speed trains (HST which propagate waves that result in ground vibrations that can be particularly undesirable. One of these waves, known as the Rayleigh wave, is formed from the interaction of P-waves and S-waves in ground layers near the surface. Particles within layers subjected to a Rayleigh wave move in ellipses parallel to the direction of wave propagation and in planes normal to the surface of the ground. At the surface and at shallow depths, the motion of the particles is retrograde (i.e. it moves in an anticlockwise direction for waves passing from left to right of the observer) with the major axis of the ellipse being vertical. Rayleigh waves can be referred to as 'ground roll' waves during earthquakes and can be highly destructive. The motion of waves in the ocean is also an example of the type of motion associated with Rayleigh waves.

When the speed of a train approaches the velocity of the Rayleigh wave generated in the sub-track material the coincidence of the train wheels with the ground wave motion can lead to rapid and excessive deformation of the track. This is often referred to as the Rayleigh wave issue and is sometimes compared to the types of effect noted in supersonic aircraft crossing the sound barrier with the aeroplane catching up with its own sound wave. It results in track safety issues; costly long-term maintenance; and potential damage to adjacent structures. The value of the Rayleigh wave velocity (also denoted herein as $V_r$ or Vr), derives (at least in part, preferably substantially completely, more preferably completely) from inherent properties of the material through which the Rayleigh wave propagates. However without wishing to be bound by any theory it is believed that Rayleigh wave velocity is dependent on the elastic constants of the materials in the ground and not the velocity of the train generating the wave. Therefore the effect of Rayleigh waves is most noticeable in soft and less dense formation material that has a comparatively low inherent Rayleigh wave velocity (Vr).

This effect was described in Krylov et al, Proceedings of the Institution of Mechanical Engineers, Part F: Journal of Rail and Rapid Transit 214 pp 107-116, 2000. Krylov characterised track behaviour at some locations of a high-speed rail line constructed in 1997-98 between Gothenburg and Malmo in Sweden. At locations with very soft ground conditions a Rayleigh wave velocity as low as 45 $ms^{-1}$ was observed. At this ground wave speed, trains travelling a speed as low as 165 km/h generated Rayleigh wave effects such as poor ride quality and rapid development of poor track alignment. (for convenience train speed is also denoted herein as $V_t$ or Vt). Thus it can be seen that with sufficiently soft ground it is possible to observe the Rayleigh wave effect at normal train speeds, not just speeds that might be associated with high speed train travel. Rayleigh wave effects are seldom a problem over dense or stiff subgrades, such as solid rock, as within such subgrades the Rayleigh wave will travel well above the maximum speed of any train (Vr will be much greater than Vt). However as maximum train speeds increase the issue of Rayleigh waves becomes more important. For example the maximum train speed for the UK high speed railway designated "HS2" is proposed to be up to 400 km/h (~250 mph or ~110 $ms^{-1}$) and at these speeds Vt will approach or be greater than Vr for most if not all of the sub-grades likely to be encountered on route. The issue of Rayleigh waves was highlighted in written evidence from David Rayney dated 15 May 2011 which was submitted to the UK Parliamentary committee considering HS2.

There is a further effect which must be considered when constructing track beds for use with high speed trains. The track critical velocity (denoted as $V_c$ or Vc) is the maximum speed at which trains can safely travel on a given track. Vc is defined mostly by properties of track itself such as the mass and flexibility of rails, whether the rails are continuously welded or have gaps between rails, and the distance between sleepers. These rail properties influence the freedom and degree to which the rail may bend when subject to forces due to axle load on the track causing vertical vibration in the rails. However Vc is also influenced to some degree by properties of the ground on which track is laid such as the modulus of underlying substrate or sub ballast layer. If the train velocity (Vt) is greater than this track critical velocity (Vc) then axle load from the train will cause excessive vertical displacement of rail track, enhanced vibration and even train derailment. For modern high-speed trains, it is much more likely that Vt will approach or exceed Vc when the track is laid over more types of commonly occurring substrate that would not be an issue for trains travelling at lower speeds.

The above effects arise inherently from the much higher speeds of an HST compared to a conventional train and significantly limit the choice of the type of unmodified subgrade materials on which the track bed for a HST can be laid. This significantly constrains the potential routes available to build a high-speed track which may be limited to solid rock unless means are found to stabilize the track bed and raise Vr and/or Vc above the Vt values typical and/or desired for a HST.

Current methods used to mitigate against low shear Rayleigh wave velocity (Vr) and/or to increase critical track velocity (Vc) are not satisfactory as, whilst they may succeed in addressing these issues, they introduce other problems, for example they are expensive, time consuming or in the case of chemical stabilization have potential negative environmental impacts. It has been proposed to dig out soft material (such as clays) underlying the track and replaced this with engineered, stiffer filling materials such as quarried materials. However to provide ground suitable to support high speed trains would require excavating a large amount of material (e.g. up to a 5 m depth of clay would need to be replaced with granular material). An alternative method of increasing Vr is to stabilize the soft material underlying the track bed with cement, lime and/or other chemical stabilizers to increase the stiffness of the material in-situ. These methods can also be combined. However due to their cost none of the known methods used to mitigate Rayleigh waves is commercially attractive as they make the laying of new high speed railways over such soft ground a very expensive undertaking.

Use of geogrid to address the issue of Rayleigh waves generated in railway tracks has been briefly described in two documents. A newsletter published by GSS as "Ground Stiffness News, Issue 3, Summer 2017, page 2 (GSS2) stated:

"Tensar trial embankment: In conjunction with Coffey Geotechnics, GSS has been undertaking CSW testing for Tensar International on its geogrid trial embankment site in Somerset. CSW testing has been used to assess and model formation stiffness improvements over a range of geogrid installations within the embankment. Use of CSW testing also provides direct measurement of Rayleigh wave velocity, a key concern for high speed rail track formation."

A similar report of the same trial was provided by GSS on the web site dated 15 Feb. 2017 (GSS1) which stated:

"In conjunction with Coffey, GSS has been conducting trials on the effects of geogrid construction on formation stiffness for Tensar International. CSW directly measures Rayleigh wave velocity which is a significant concern for track-bed for high speed trains. Using this advanced measurement technique the benefits of geogrids for formation design can be accurately established for design optimisation"

Neither document GSS1 nor GSS2 discloses further details of the geogrid constructions used in this trial, they focus more on the measurement techniques used to assess ground properties. There is nothing in either reference which would motivate a skilled person reading either document to overcome the technical prejudice described previously about where and how a geogrid should be used to support a railway track. A reader of GSS1 and/or GSS2 would simply assume the geogrid would be positioned at conventional, shallow depths (0.6 m or less) below the railway track bed as has been done for the last 25 years, noting in particular the Krylov study that demonstrated that Rayleigh waves are a concern in trains operating at normal speeds over relatively soft ground and are therefore not associated exclusively with very high-speed trains such as "HS2".

SUMMARY OF THE INVENTION

It is an object of the present invention to obviate or mitigate the abovementioned disadvantages with prior art stabilization methods.

Surprisingly and contrary to what a skilled person would have been predicted from the prior art, the applicant has discovered a novel form of stabilized geo engineered railway construction in which the optimum position of the geogrid can be determined which may be optionally located much deeper than in prior art geogrid stabilized tracks. This can be used advantageously to address issues described herein associated with high speed trains for example by raising the inherent Rayleigh wave velocity (Vr) of the stabilized layer and/or the track critical velocity (Vc) of a track laid on the stabilized layer in a cost-effective manner which allows high speed track to be laid over a wider selection of types of ground that has been possible before.

Therefore broadly in accordance with the present invention there is provided geogrid engineering construction for railways (railway geogrid construction), the construction comprising:

a track bed (optionally the track bed comprising rails) which defines a track located on a track plane;

a mass of particulate material forming a layer located beneath the track plane; and at least one geogrid located in and/or below the particulate layer, where the at least one geogrid is located in a plane (geogrid plane) substantially parallel to the track plane where the average distance between the track plane and the at least one geogrid plane, measured perpendicular to both planes, and denoted herein as Dr, is greater than 0.65 metres.

It will be appreciated that the railway geogrid construction of the invention may comprise one or a plurality of geogrids (for example two or three geogrids) where the or each geogrids are located in one or more planes (geogrid planes) substantially parallel to the track plane where each average distance between the track plane and each geogrid plane, measured perpendicular to the planes between which the distance is being measured, is denoted herein as $Dr_n$, (where n is a sequential number allocated to the each geogrid) and the distance of at least one $Dr_n$ for at least one of the geogrid planes is greater than 0.65 metres. Usefully where the railway geogrid construction comprises a plurality of geogrids (for example two or three geogrids) the geogrids are each located on different geogrid planes located at different average distances ($Dr_n$) beneath the track plane. It is also possible that when there are two or more geogrids at least one geogrid may be located a depth on or shallower than 0.65 m below the track provided at least one geogrid is also located at least 0.65 m beneath the track, although in preferred railway geogrid constructions of the present invention, each geogrid has a $Dr_n$ greater than 0.65 m.

Optionally in the railway geogrid construction of the invention the particulate layer is that is stabilized by the geogrid may be located immediately beneath the track bed and the stabilized particulate layer may have an average layer thickness (denoted $T_p$ or Tp) which is less than or equal to Dr. Preferably Tp is less than 0.5 m, more preferably less than 0.4 m, most preferably from 0.1 m to 0.35 m. It will be appreciated that Tp cannot be more than Dr but may be less than Dr if not all the material between the track and the geogrid forms part of the particulate layer that is stabilized by the geogrid, which layer is also referred to herein as a geogrid stabilized layer or GSL. Where the stabilization of the GSL is due to mechanical interlocking of the particles and the mesh of the geogrid the GSL may also be referred to herein as a mechanically stabilized layer or MSL. The preferred mode of operation of a GSL used in the present invention is as a MSL.

Preferably Dr is greater than or equal to 0.7 metres, more preferably ≥0.8 m, even more preferably ≥0.9 m most preferably ≥1 m.

Usefully Dr is less than or equal to 5 metres, more usefully ≤4 m, even more usefully ≤3 m most usefully ≤2 m.

Dr may be from 0.65 to 5 metres, conveniently from 0.7 to 5 metres, more conveniently from 0.8 to 4 m, even more conveniently from 0.9 to 3 m, most conveniently from 1 to 2 m.

Usefully the railway geogrid construction of the invention when subject to a train running on the track thereof generates a Rayleigh wave velocity in the particulate layer (e.g. aggregate, soil, ballast and/or sub ballast beneath the track) of at least 140 $ms^{-1}$ (~500 kph or ~310 mph); more usefully at least 150 $ms^{-1}$ (~540 kph or ~335 mph); even more usefully at least 160 $ms^{-1}$ (~575 kph or ~360 mph); such as ≥167 $ms^{-1}$ (~600 kph or ~375 mph); most usefully at least 170 $ms^{-1}$ (~610 kph or ~380 mph); for example at least 180 $ms^{-1}$ (~600 kph or ~375 mph); e.g. ≥185 $ms^{-1}$ (~665 kph or ~415 mph); advantageously ≥200 $ms^{-1}$ (~720 kph or ~450 mph), more advantageously ≥220 $ms^{-1}$ (~790 kph or ~490 mph), even more advantageously ≥250 $ms^{-1}$ (~900 kph or ~560 mph) and most advantageously ≥280 $ms^{-1}$ (~1000 kph or ~620 mph).

For convenience the conversions of speed units herein (e.g. between $ms^{-1}$, kph and/or mph) are only approximate and are typically rounded to about the nearest 5 units as indicated by "about" and/or the tilde symbol "~". Speeds of kilometers per hour or km/hr are also denoted herein as kph and miles per hour as mph.

Conveniently the railway geogrid construction of the invention when subject to a train running on the track thereof has critical track velocity in the track thereof of at least 140 $ms^{-1}$ (~500 kph or ~310 mph); more conveniently at least 150 $ms^{-1}$ (~540 kph or ~335 mph); even more conveniently at least 160 $ms^{-1}$ (~575 kph or ~360 mph); such as ≥167 $ms^{-1}$ (~600 kph or ~375 mph); most conveniently at least 170 $ms^{-1}$ (~610 kph or 380 mph); for example at least 180 $ms^{-1}$ (~600 kph or ~375 mph); e.g. ≥185 $ms^{-1}$ (~665 kph or ~415 mph); advantageously ≥200 $ms^{-1}$ (~720 kph or ~450 mph), more advantageously ≥220 $ms^{-1}$ (~790 kph or ~490 mph), even more advantageously ≥250 $ms^{-1}$ (~900 kph or ~560 mph) and most advantageously ≥280 $ms^{-1}$ (~1000 kph or ~620 mph).

Advantageously the railway geogrid construction of the invention has a Rayleigh wave velocity generated by trains travelling along the track thereof, at least 10% above, more preferably at least 15% above, even more preferably at least 20% above, most preferably at least 25% above and for example at least 33% above the maximum speed at which trains would be allowed to travel along the track (denoted herein as the Track Speed Limit (TSL).

Tracks of the present invention; tracks comprising geogrids of the invention and/or geogrids as described herein and/or tracks made according to the method of present invention may be usefully have a TSL of at least 55 $ms^{-1}$ (~125 mph or ~200 kph), more usefully 69 $ms^{-1}$ (~155 mph or ~250 kph); and optionally may have an upper limit of the TSL that is less than or equal to 200 $ms^{-1}$ (~720 kph or ~450 mph). In further embodiments of the invention the TSL may preferably be less than or equal to 140 $ms^{-1}$ (~500 kph or ~310 mph); more preferably ≤150 $ms^{-1}$ (~540 kph or ~335 mph); even more preferably ≤160 $ms^{-1}$ (~575 kph or ~360 mph); such as ≤167 $ms^{-1}$ (~600 kph or ~375 mph); most preferably ≤170 $ms^{-1}$ (~610 kph or ~380 mph); for example ≤180 $ms^{-1}$ (~600 kph or ~375 mph); e.g. ≤185 $ms^{-1}$ (~665 kph or ~415 mph).

Conveniently the railway geogrid construction of the invention has a critical track velocity at least 10% above, more preferably at least 15% above, even more preferably at least 20% above, most preferably at least 25% above and for example at least 33% above the Track Speed Limit.

Advantageously the railway geogrid construction of the invention provides an increase in the Rayleigh wave velocity and/or critical track velocity, compared to the same railway construction without a geogrid therein laid on the same sub grade material (denoted herein the Comparative Track) of at least 10% above, more preferably at least 15% above, even more preferably at least 20% above, most preferably at least 25% above and for example at least 33% above the Rayleigh wave velocity generated by a train travelling at the same speed on the Comparative Track.

A yet further aspect of the invention broadly provides use of a geogrid and/or component thereof to increase the speed of the Rayleigh wave therein and/or increase the critical track velocity of a track laid thereon above a maximum allowed train velocity (also denoted herein as Track Speed Limit (TSL)) of at least 55 $ms^{-1}$ (~125 mph or ~200 kph), preferably ≥69 $ms^{-1}$ (~155 mph or ~250 kph) more preferably of and/or in any of the values and/or the ranges as described herein as desired and/or suitable for high speed trains whether exact or approximate conversion values.

Another aspect of the invention broadly provides a method for constructing a geogrid engineering construction for railways (railway geogrid construction) the method comprising the steps of:

providing a track bed (optionally the track bed comprising rails) which defines a track located on a track plane;

providing a particulate layer lying beneath the track plane with a geogrid located in and/or adjacent to the particulate layer, where the geogrid is located in a plane (geogrid plane) substantially parallel to the track plane where the average distance between the track plane and geogrid plane, measured perpendicular to both, and denoted herein as Dr, is greater than 0.65 metres.

Preferably in the method of invention for constructing the railway geogrid construction, the railway geogrid construction is of the present invention and/or as described herein.

A further aspect of the invention provides constructing a geogrid stabilized particulate mass (e.g. aggregate, soil, ballast and/or sub-ballast layer(s)) for use in a method of the present invention and a geogrid stabilized particulate mass (e.g. aggregate, soil, ballast and/or sub-ballast layer(s)) obtained and/or obtainable by such a method. It will be appreciated and understood by a skilled person that the particulate mass stabilized according to the present invention may be any suitable particle mass that is capable of supporting a railway track and being stabilized as described herein and are not limited to the one or more aggregate, soil, ballast and/or sub-ballast layer(s) specifically mentioned above which are by way of non-limiting examples of the types of materials that may be used. It will also be appreciated that the particulate mass (which is stabilized as described herein) may comprise new and/or off site material which may replace in whole or in part the material previously located underneath where the railway track is to be laid, upgraded and/or replaced and/or may comprise local material such as soils excavated from beneath the track location (which may be optionally reused) and/or combinations and/or mixtures of any suitable materials.

A yet other aspect of the invention broadly provides a geogrid suitable for stabilizing a particulate mass (e.g. aggregate soil ballast and/or sub-ballast layer(s)) and/or component(s) thereof, where the geogrid and/or component (s) have the at least one of the desired geogrid properties described herein such as at least one of any of properties (i) to (vi) described in the following section; preferably comprising one or more, preferably two or more, more preferably three or more, even more preferably four or more, most preferably five or more, for example all six, of any of the following properties i) to vi) (further explained herein and/or measured as described herein):

i) Radial Secant stiffness at 0.5% strain of at least 100 kN/m, preferably of from 200 to 800 kN/m more preferably of from 220 to 700 kN/m, most preferably of from 250 to 600 kN/m with further optionally in each case a tolerance of from minus (–) 60 to minus (–) 100.

ii) Radial Secant stiffness at 2% strain (in kN/m) of at least 80 kN/m, preferably of from 150 to 600 kN/m more preferably of from 170 to 500 kN/m, most preferably of from 200 to 450 kN/m with further optionally in each case a tolerance of from minus (–) 60 to minus (–) 100.

iii) Radial Secant stiffness Ratio (dimensionless) of at least 0.5 preferably of from 0.6 to 0.9, most preferably of from 0.70 to 0.85, most preferably of from 0.75 to 0.80, with further optionally in each case a tolerance of from minus (–) 0.10 to minus (–) 0.20, more optionally minus (–) 0.15.

iv) Junction efficiency of at least 90% preferably at least 95%, more preferably of at least 97%, most preferably of at least 99%, for example of 100%, with further optionally in each case a tolerance of at least minus (–) 10.

v) Pitch (preferably hexagon pitch) of at least 30 mm, preferably of from 40 to 150 mm, more preferably of from 50 to 140, most preferably of from 65 to 125 mm, with further optionally in each case a tolerance of from minus (–) 60 to minus (–) 100.

vi) Product weight of at least 0.100 $kg/m^2$, preferably of from 0.120 to 0.400 $kg/m^2$, more preferably of from 0.150 to 0.350 $kg/m^2$, most preferably of from 0.170 to 0.310 $kg/m^2$, for example from 0.180 to 0.300 $kg/m^2$ with further optionally in each case a tolerance of from minus (–) 0.025 to minus (–) 0.040, more optionally of from minus (–) 0.030 to 0.035.

Further details of the properties that may contribute to the performance of a geogrid stabilized layer of use in the present invention are provided in the Examples herein.

In a further optional aspect of the present invention geogrids of and/or used in the present invention are sufficiently durable to have a minimum working life of the geogrid in natural soils with a pH value between 4 and 9 of at least 100 years where the particulate mass to be stabilized has a mean temperature of less than 15° C. and/or of at least 50 years where the particulate mass to be stabilized has a mean temperature of less than 25° C.

It is a further optional advantage of the geogrids of and/or used in the present invention that they need not have particularly high creep reduction factor as for the uses described herein the geogrids are typically not subject to constant strain, the operational strain level being normally about 0.5%, a level which would not usually impart significant creep to the geogrid. This allows more options for a skilled person to manufacture geogrids that will be suitable for use in the present invention as described herein.

Optionally geogrids of and/or used in the present invention comprise an integral mesh structure defined by mesh defining elements that define aperture elements. Optionally the mesh defining elements are of uniform thickness. Optionally the mesh defining elements comprise elongate tensile elements (ribs) interconnected by junctions (nodes) in the mesh structure. Conveniently the mesh defining elements may comprise a plurality of generally parallel rib structures (such as ribs) extending in the cross-machine direction (TD), and/or a plurality of spaced, generally parallel rib structures (such as connectors) extending an angle (mesh angle) to the TD. Where the rib structures are substantially perpendicular to the rib structures (i.e. the mesh angle is about 90°) the rib structures lie approximately in the transverse direction (TD) of the geogrid. Embodiments of geogrids may also comprise one or more mesh angles from 30° to 90° to form aperture elements having a triangular shape (viewed from above the plane of the geogrid), preferably from 3 to 8 sides, more preferably 3 or 4 sides, most preferably a substantially rectilinear polygon (e.g. rectangle where the mesh angle is about 90° shape) and/or a substantially triangular polygon (e.g. substantially equilateral triangle where the mesh angle is about) 60°. It will be appreciated that the aperture elements may be defined by sharp vertices where a plurality of mesh elements meet directly, or may preferably be defined partially by curved sections for example where the mesh elements meet via junctions to avoid regions of excessive stress that may be created by sharp vertices. Usefully the mesh defining elements comprise, more usefully consist of, one or more rib structures, junctions and/or elongate tensile elements.

In preferred geogrids for use in railway geogrid constructions of the present invention, the molecular oriented polymers that comprise the polymer geogrid may be oriented by the polymer grid (and/or the polymer web from which the grid is formed) having been stretched in at least one direction at a stretch ratio of at least 2 to 1, more preferably of at least 3 to 1. Usefully in one embodiment the stretch ratio may be from 2 to 1 to 12 to 1, more usefully from 2 to 1 to 10 to 1 and most usefully from 3 to 1 to 6 to 1. Generally, the stretch ratio will not exceed 12 to 1, more preferably will not exceed 10 to 1 and most preferably will not exceed 6 to 1. Stretch ratios may be determined by means of "truth lines" which are lines applied (normally by printing or drawing) to the starting material, usually in two perpendicular directions. Orientation at a particular location can be determined as the stretch ratio between two reference points, one on each of two truth lines positioned either side of the location where the orientation is to be measured, said reference points being closely adjacent to said location. Truth lines are generally only used for experimental work and not production runs.

Molecular orientation (such as uniform molecular orientation) of polymers within a geogrid may be determined by many techniques well known in the art. A skilled person would understand that the molecular orientation of the polymer is an inherent intrinsic property of the material arising from increased alignment of the polymer material whether alignment of polymer chains when an amorphous polymer is stretched in the direction of orientation and/or due to alignment of polymer chains and/or polymer crystalline regions when an semi-crystalline or crystalline polymer is stretched in the direction of orientation. Thus degree if orientation of a polymer measured in any direction and however defined (e.g. by a draw or stretch ratio) does not require knowledge of the process by which the polymer was made as it is an inherent measurable property of the polymeric material. Suitable techniques for measuring polymer orientation may include but are not limited to any of the following: X-ray diffraction, attenuated total reflection (ATR) by Fourier transform infra-red (FT-IR) spectroscopy, birefringence, sonic modules, polarized fluorescence, broad line NMR, UV and infrared dichroism, polarized spectroscopy; and/or shrinkage reversion. XRD and/or shrinkage reversion are particularly suitable for determining molecular orientation of polymers in geogrids given geogrids are thicker than many polymeric films prepared for other uses are typically opaque to some radiation having UV absorbers such as carbon black dispersed therein. A non-limiting example of a particularly preferred, practical test for determining polymer orientation of the geogrids of the present invention is the shrinkage reversion test.

Some of the geogrids for use in railway geogrid constructions of the present invention may have a tensile strength of at least 15 kN/m, preferably at least 25 kN/m, although without wishing to be bound by any theory, the applicant believes that having a tensile strength of these values are not an essential requirement for geogrids of and/or suitable for use in the present invention. Tensile strengths of geogrids as quoted herein are determined in accordance with BS EN ISO 10319:2015, which test defines tensile strength of a geosynthetic as the maximum force per unit width observed during a test in which the specimen is stretched to rupture expressed in units of kN/m. For convenience and simplicity tensile strength of geogrids may also be quoted in units of kN in which case the value of tensile strength will be assumed to correspond to that obtained for a geogrid of 1 m width tested in ISO 10319:2015. Variation in tensile strength may be achieved in a number of ways, e.g. by varying the thickness of the geogrid, the polymer from which it is manufactured, or the lateral spacing and/or width of the rib tensile elements.

Some of the geogrids for use in railway geogrid constructions of the present invention may have a Secant stiffness (optionally measured in the plane of the geogrid defined by the TD and MD at a strain of 0.5%) of at least 400 kN/m, preferably at least 450 kN/m, although without wishing to be bound by any theory, the applicant believes that having a stiffness of these values are not an essential requirement for geogrids of and/or suitable for use in the present invention. Conveniently the stiffness is a Secant stiffness which unless otherwise indicated is measured at a strain of 0.5%, although Secant stiffness may also be measured at a strain of 2% in which case the stiffness will be lower by approx. 100 kN/m in value compared to the Secant stiffness measured at 0.5% strain.

Usefully the width of the mesh defining elements (such as elongate tensile elements) in any geogrid of and/or used in the present invention may be from 2 to 100 mm, and in one embodiment preferably from 2 to 50 mm, more preferably from 5 to 40 mm, most preferably from 10 to 20 mm or in another embodiment optionally from 2 to 20 mm.

Advantageously the width of the rib structures in any geogrid of and/or used in the present invention may be from 2 to 50 mm, and in one embodiment more preferably from 5 to 40 mm, most preferably from 10 to 20 mm or in another embodiment optionally from 2 to 20 mm, more optionally from 6 to 18 mm, most optionally from 10 to 15 mm.

Conveniently the depth (thickness) of the mesh defining elements in any geogrid of and/or used in the present invention may be from 0.1 to 10 mm, more preferably from 0.2 to 5 mm, even more preferably from 0.2 to 2 mm, most preferably from 0.4 to 2 mm.

Usefully the length of the aperture elements (which conveniently may be the dimension of the longest side where the aperture is substantially a polygon) in any geogrid of and/or used in the present invention may be from 5 to 400 mm, more usefully 40 to 300 mm, even more usefully from 40 to 250 mm, most usefully from 50 to 200 mm.

Conveniently the pitch of the aperture elements in any geogrid of and/or used in the present invention (which usefully may be the dimension of one repeat unit in the MD where the aperture is substantially a polygon) may be from 3 to 420 mm, more conveniently 30 to 310 mm, even more conveniently from 35 to 260 mm, most conveniently from 40 to 210 mm. A repeat unit includes the dimension of the aperture an one rib in each dimension in the plane of the grid such that when tessellated a repeating, identical mesh is formed.

Advantageously the width of the aperture elements in any geogrid of and/or used in the present invention may be the same as the length especially if the aperture is symmetrical (e.g. a square or circle). In some useful embodiments the aperture length is greater than the aperture width. Preferably the width of the aperture element is from 5 to 80 mm, and in one embodiment more preferably from 10 to 80 mm, even more preferably from 20 to 75 mm, most preferably from 25 to 70 mm or in another embodiment optionally from 5 to 50 mm.

Preferred geogrid of and/or used in the present invention may have a mean thickness of from 0.1 to 10 mm, more preferably from 0.2 to 5 mm, even more preferably from 0.2 to 2 mm, most preferably from 0.4 to 2 mm.

In one embodiment of a railway geogrid construction of the invention comprises a geogrid having mesh defining elements that have a width of 2 to 100 mm and/or the mesh defining elements defining mesh apertures (optionally which apertures may be of identical size and/or shape) having a mean length and/or a mean width of from 5 to 400 mm and/or the geogrids have a mean thickness (optionally which is uniform) of from 0.1 m to 10 mm.

A still further aspect of the invention broadly provides a method for preparing a stabilized layer using a geogrid comprising providing one or more component(s) and/or composition(s) of present invention (and/or as described herein).

Optionally, without wishing to be bound by any theory the applicant has further found in other optional aspects of the invention that a Shear wave velocity may be used to calculate a Rayleigh wave velocity using Equation1 (or Equation 1A) as described herein:

$$V_r = \left(\frac{A + B\nu}{1 + \nu}\right)V_s, \qquad \text{Equation 1}$$

where $V_r$ (or Vr) denotes the Rayleigh Wave velocity through material (such as the ground beneath a railway track) having elastic properties (elastic material);

$V_s$ (or Vs) denotes the velocity of shear waves through the elastic material;

$\upsilon$ denotes the Poisson ratio (the signed ratio of transverse strain to axial strain which is dimensionless) which preferably is from 0.1 to 0.5, more preferably from 0.2 to 0.4, even more preferably from 0.2 to 0.35, most preferably from 0.22 to 0.30, for example 0.26; and A and B represent dimensionless constants: where A is from 0.8 to 1.0, preferably from 0.85 to 0.90, more preferably from 0.87 to 0.88; most preferably is from 0.872 to 0.876, for example 0.874 (to 3 decimal places); and B is from 1.0 to 1.2, preferably from 1.05 to 1.20, more preferably from 1.10 to 1.15, most preferably is from 1.112 to 1.120, for example 1.117 (to 3 decimal places).

Equation 1A (described in the Examples section herein) is a subset of Equation 1 which has specific values for constants A and B, where A=0.874 and B=1.117.

The Poisson ratio may also vary with the material present in the particulate mass to be stabilized. Thus for example in one embodiment of the invention where the particulate material comprises saturated clay, preferred values of $\upsilon$ may be from 0.4 to 0.5. In another embodiment of the invention where the particulate material comprises unsaturated or partially saturated clay, preferred values of $\upsilon$ may be from 0.1 to 0.3.

The shear wave velocity derived from Equation1 (or Equation 1A) may be converted to a small strain shear modulus ($G_0$) using the simple relationship with ground density defined in Equation 2 below. Given the nature of the relationship with, and limited variance of, ground density (e.g. if the ground comprises or consists of soil) the value of $G_0$ can be assumed to be relatively insensitive to assumed density of the elastic material (e.g. ground) if this density is not known.

$$G_0 = \rho(V_s)^2 \qquad \text{Equation 2, where}$$

$G_0$ the small strain stiffness property; and $\rho$ is density of the elastic material.

Equations 1 and 2 can be used to predict the velocity of a Rayleigh wave that may be generated with the sublayer on which a railway track is laid from the properties of the sublayer alone, i.e. using Equation 3:

$$V_r = \left(\frac{A + B\nu}{1 + \nu}\right)\sqrt{\frac{G_0}{\rho}}, \qquad \text{Equation 3}$$

As maximum train speed (denoted as $V_{tmax}$ or Vtmax, also referred to as track speed limit or TSL) must be lower than Vr to avoid or mitigate against excessive damage, the desired sub layer properties can be also calculated using a desired maximum train speed using the relationship given in Equation 4 below.

$$V_{tmax} \geq \left(\frac{A + B\nu}{1 + \nu}\right)\sqrt{\frac{G_0}{\rho}} \qquad \text{Equation 4}$$

For high speed trains Vtmax is at least 55 $ms^{-1}$ (~125 mph or ~200 kph) preferably ≥69 $ms^{-1}$ (~155 mph or ~250 kph) and thus a railway geogrid construction of the invention may usefully have a sub layer properties that satisfy Equation 4 where Vtmax is at least 55 $ms^{-1}$, preferably ≥69 $ms^{-1}$, more preferably where Vtmax has and/or is in any of the values and/or the ranges as described herein as desired and/or suitable for high speed trains.

Broadly in accordance with the foregoing a still further aspect of the present provides a geogrid engineering construction for railways (railway geogrid construction), the construction comprising:

a track bed(optionally the track bed comprising rails) which defines a track located on a track plane;

a particulate layer lying beneath the track plane; and a geogrid located in and/or adjacent to the particulate layer, where the geogrid is located in a plane (geogrid plane) substantially parallel to the track plane such that the geogrid stabilizes the particulate layer such that the properties of the particulate layer satisfy Equation 4A;

$$55 \geq \left(\frac{A + B\nu}{1 + \nu}\right)\sqrt{\frac{G_0}{\rho}} \quad \text{Equation 4A}$$

where

υ denotes the Poisson ratio of the particulate layer, which preferably is from 0.1 to 0.5, more preferably from 0.2 to 0.4, most preferably from 0.2 to 0.35;

$G_0$ is the small strain stiffness property of the particulate layer; and

ρ is the density of the particulate layer; and where optionally the average distance between the track plane and geogrid plane, measured perpendicular to both, and denoted herein as Dr, is greater than 0.65 metres, more preferably Dr has and/or is in any of the values and/or the ranges as described herein as desired and/or suitable for the present invention.

A yet further aspect of the present invention provides a method for constructing a geogrid engineering construction for railways (railway geogrid construction), the method of construction comprising:

defining a track bed plane (optionally the track bed comprising rails) along which the track bed will be located;

providing a particulate layer beneath the track plane with a geogrid located in and/or adjacent to the particulate layer, where the geogrid is located in a plane (geogrid plane) substantially parallel to the track plane such that the geogrid stabilizes the particulate layer such that the properties of the particulate layer satisfy Equation 4A;

$$55 \geq \left(\frac{A + B\nu}{1 + \nu}\right)\sqrt{\frac{G_0}{\rho}} \quad \text{Equation 4A}$$

where v denotes the Poisson ratio of the particulate layer, which preferably is from 0.1 to 0.5, more preferably from 0.2 to 0.4, most preferably from 0.2 to 0.35;

$G_0$ the small strain stiffness property of the particulate layer; and

ρ is density of the particulate layer; and where optionally the average distance between the track plane and geogrid plane, measured perpendicular to both, and denoted herein as Dr, is greater than 0.65 metres more preferably Dr has and/or is in any of the values and/or the ranges as described herein as desired and/or suitable for the present invention.

In this aspect of the invention there is provided a means to determine optimum placement of a geogrid to minimize adverse effects of Rayleigh waves and/or raise the track critical velocity. For some types of particulate material it may be found that the optimum depth is shallower that the preferred depth of 0.65 m in the constructions described elsewhere herein.

A still further aspect of the present invention there is provided use of a geogrid in a method to construct a geogrid engineering construction for railways (railway geogrid construction comprising:

defining a track bed plane (optionally the track bed comprising rails) along which the track bed will be located;

defining an particulate layer lying beneath the track plane with a geogrid located in and/or adjacent to the particulate layer, the geogrid being located in a plane (geogrid plane) substantially parallel to the track plane such plane being defined such that the geogrid is calculated to stabilize the particulate layer such that the properties of the particulate layer satisfy Equation 4A;

$$55 \geq \left(\frac{A + B\nu}{1 + \nu}\right)\sqrt{\frac{G_0}{\rho}} \quad \text{Equation 4A}$$

where

υ denotes the Poisson ratio of the particulate layer which preferably is from 0.1 to 0.5, more preferably from 0.2 to 0.4, most preferably from 0.2 to 0.35

$G_0$ the small strain stiffness property of the particulate layer; and

ρ is density of the particulate layer; and where optionally the average distance between the track plane and geogrid plane, measured perpendicular to both, and denoted herein as Dr, is greater than 0.65 metres more preferably Dr has and/or is in any of the values and/or the ranges as described herein as desired and/or suitable for the present invention.

Many other variations and embodiments of various aspects of the invention will be apparent to those skilled in the art and such variations are contemplated within the broad scope of the present invention. Thus it will be appreciated that certain features of the invention, which are for clarity described in the context of separate embodiments may also be provided in combination in a single embodiment. Conversely various features of the invention, which are for brevity, described in the context of a single embodiment, may also be provided separately or in any suitable sub-combination.

Aspects of the invention and preferred features thereof are given in the claims herein, which form an integral part of the disclosure of the present invention whether or not such claims correspond directly to parts of the description herein. It will be appreciated that the literal meaning that may be inferred from the claims herein, may not limit a proper scope of protection that may be afforded by the amended claims with respect to infringement outside their non-literal scope in accordance with applicable local law. Therefore no inference should be made from statements in the description that may relate to the literal meaning of the claims that any embodiments, examples and/or preferred features described in the application are excluded from such scope of protection.

Certain terms as used herein are defined and explained below unless from the context their meaning clearly indicates otherwise.

Unless defined otherwise, all technical and scientific terms used herein have and should be given the same meaning as commonly understood by one of ordinary skill in the art to which this invention belongs.

Unless the context clearly indicates otherwise, as used herein plural forms of the terms herein are to be construed as including the singular form and vice versa.

Geogrids

Geogrids are high tensile strength mesh structures used to stabilize or reinforce particulate material (e.g. soil or particulate) in geoengineering constructions. More particularly, the geogrid is embedded in the particulate material of the construction so that this material can then lock into the open meshes of the geogrid. Geogrids can be manufactured in many different ways, for example by stitch bonding fabrics made of, for instance, polymer filaments and applying a flexible coating such as PVC or bitumen, or by weaving or by knitting, or even joining oriented plastic strands together. A geogrid has inherent structural limitations to make the mesh suitable for use in civil engineering and specifically for use in stabilize railway tracks for use with high speed trains as described herein. Preferred geogrids for use as described herein are in the form of an integral, mesh structure that comprise molecularly oriented polymers wherein the geogrid is uniaxially or biaxially oriented. In one embodiment geogrid for use as described herein may be in the form of an integral, molecularly oriented, plastic mesh structures formed of inter-connecting mesh defining elements including elongate tensile elements.

It is known that geogrids can be produced by stretching a plastics sheet starting material which has been provided (e.g. by punching) with an array of holes (e.g. on a rectangular, or other suitable grid pattern). Stretching of the plastics sheet starting material produces a geogrid in the form of a mesh structure comprised of mesh defining elements including elongate tensile elements and also junctions, the tensile elements being interconnected at least partly by the junctions. Such geogrids are often referred to as "punch and stretch" geogrids. In the production of geogrids by this process, the stretching operation "draws out" polymer in the stretch direction into the form of elongate tensile elements with consequential enlargement of the holes in the original sheet starting material to produce the final mesh structure (i.e. the geogrid). The stretching operation provides molecular orientation of the polymer (in the stretching direction) in the elongate tensile elements and also (but to a lesser extent) in the junctions. The degree of orientation may be represented by the "stretch ratio" which is the ratio of the distance between two points on the surface of the geogrid as compared to the distance between the corresponding points on the sheet starting material (i.e. prior to stretching). It is the molecular orientation that provides the required strength characteristics for the geogrid (since molecularly oriented polymer has considerably higher strength in the stretch direction than non-oriented polymer). The molecular orientation is irreversible under normal temperature conditions, to which the geogrid is exposed after its manufacture, e.g. during storage transport and use.

Geogrids produced by stretching of apertured plastics sheet starting materials may be uniaxially or biaxially oriented. In the case of a uniaxially oriented ("uniax") geogrid, stretching has been effected in only a single direction, whereas a biaxially oriented ("biax") geogrid has been produced by employing two stretching operations transverse to each other in the plane of the sheet starting material, these operations usually being perpendicular to each other and generally effected sequentially (but can be effected simultaneously with the appropriate equipment known within the industry). Such techniques for producing uniax and biax mesh structures by stretching an apertured plastics sheet starting material in one direction (for a uniax product) or two directions (for a biax product) are disclosed, for example, in GB2035191 (equivalent to U.S. Pat. No. 4,374,798 and EP0374365). Further examples of geogrids are shown in WO 2004/003303 and WO 2013/061049.

Geogrids (such as grids and/or meshes, for example as described herein) are mainly used to stablise unbound layers by assisting the interlock of particles within and/or between the layers, this stabilization function being defined by for example European Organisation for Technical Assessment (EOTA) European Assessment Document (EAD) 080002-00-0102 and in Europe a geogrid has a European Technical Assessment (ETA) certification for this stabilization A geogrid is preferably manufactured in accordance with a management system which complies with the requirements of BS EN ISO 9001:2008. More preferred geogrids of and/or for use in the present invention comprise a hexagonal structure with triangular apertures manufactured from a punched and stretched polypropylene sheet which is then oriented in three directions so that the resulting ribs of general rectangular cross-section have a high degree of molecular orientation which continues through the mass of the integral node or junction. Typical geogrids have a minimum content of 2% by weight if finely divided carbon black by total weight of the geogrid being 100%.

Railway Track

Railway or railway track as used herein (also referred to as a "railroad" which term is synonymous) denotes a track which defines a path along which a train, tram or other similar guided vehicle will run and where directional guide means are also provided that assist the vehicle in following the track. A train denotes any vehicle capable of travelling along a railway and being guided by the directional guide means. Preferably in one aspect of the invention the directional guide means comprise parallel rails (made from steel or other suitable material) set at a fixed distance apart (this distance denoted the gauge). The train wheel axles have the same fixed gauge so they can support the train and be guided along the track as they run along the rails. Commonly used gauges being standard, broad or narrow gauges, where the standard gauge of 1435 mm comprises 55% of the world's railway lines. Typically, sleepers which may be of any suitable material, commonly wood or concrete, are spaced evenly in the track direction longitudinally across the track to keep the rails apart at a constant gauge. However other track configurations without rails are envisaged as being within the scope of the present invention. These include for example slab-track, where the rails are attached to a reinforced concrete slab and magnetic levitation (mag-lev) tracks where rails are only optionally needed to mechanically support the vehicle which may instead or as well be supported by active or passive control of magnetic or other fields to reduce or substantially eliminate friction between the train and the track. When a train runs along such a track at a high speed, the train's high-speed motion may still generate Rayleigh waves in the ground supporting the track whether or not the train is also supported on rails. Thus, it will be appreciated that the geogrid engineering constructions of the invention are still useful for constructing railway tracks that do not have rails as the absence of rails does not prevent Rayleigh wave effects. Thus it will be understood by a skilled person that the definition of railways as used herein encompasses some tracks which comprise guide means but which may not comprise rails as such.

High Speed Trains

High speed trains (HST) refer herein to those trains which are capable of travelling at a higher speed than conventional trains by using a track designed or upgraded for high speed. EU Directive 96/48/EC defines high speed rail as a minimum speed of at least 250 km per hour (kph) (about 155 miles per hour (mph) or about 69 $ms^{-1}$) on track specially built for high speed and at least 200 kph (about 124 mph, or about 55 m $s^{-1}$) on tracks upgraded from existing tracks. Much higher speeds than these are possible for trains travelling on tracks of the present invention and are envisaged within the scope of the present invention. Typical HST may run at speeds from 200 to 500 kph (from about 124 to about 310 mph or from about 55 to 139 $ms^{-1}$). A track for a high speed railway (also referred to herein as high speed track) denotes a track along which it is suitable for a HST to travel at high speeds as defined herein. Preferred high speed tracks are specially designed to have shallower gradients and broader curves than conventional railway tracks.

Particulate Material

Railway tracks of and/or used in railway geoengineering constructions of the present invention may be laid on (directly or indirectly) one or more layers of particulate material (particulate layers) which may be stabilized, optionally mechanically stabilized, by one or more geogrids. The term "granular fill" is used herein synonymously with particulate material. It will be appreciated that the geogrids used in the constructions of the present invention are primarily used to address the issues with Rayleigh wave and/or critical track velocity as described herein, and optionally may also support the track bed above. As such support for the track bed may be provided instead and/or additionally by one or more further geogrids laid at shallow depths (e.g. from 200 to 300 mm) that are typically used by geogrids in prior art railway constructions to form a a mechanically stabilized layer (MSL) in additional to the geogrid that is located much deeper to increase Vr and/or Vc.

The particulate material that may be used with geogrids to construct the railway geoengineering constructions of the present invention may be introduced into the site as fill material (such as aggregate) and/or may comprise or consist of particulate material naturally present at the site on which the rail track is to be laid, for example soil in situ which may be temporarily excavated to form a trench into which the geogrid is laid and then reintroduced into the excavated trench. The mean particulate size may be preferably be comparable in size to the average size of the mesh aperture of the geogrid used to promote interlock of particles in the apertures to enhance mechanical stabilization. The size of the particulate material may be selected for use with the available geogrid mesh size and/or vice versa.

The particle size values of the particulate material described herein may be measured by sieving to determine the particle size distribution (PSD) of the material following BS 5930. A well-graded material has a uniformity coefficient ($C_u=D_{60}/D_{10}$) of greater than 4. However particulate masses with other PSDs (e.g. multimodal such as mono-modal or bimodal) are not excluded from this invention.

Plastic Material

A plastic material preferably denotes a material optionally comprising one or more polymers which have a sufficiently high molecular weight to provide the desired properties to the geogrid of use in applications described herein but are also capable of being processed by the application heat, pressure, and/or mechanical working to be oriented as described herein. Various polymeric materials may be used for the plastic sheet starting material (and therefore the geogrid precursor element) and non-limiting examples of suitable polymers are described herein which polymers may be thermoplastic.

Usefully geogrids of and/or used in the present invention may comprise one or more polymers from the non-limiting list of: polyolefins [e.g. polypropylene and/or polyethylene] polyurethanes, polyvinylhalides [e.g. polyvinyl chloride (PVC)], polyesters [e.g. polyethylene terephthalate—PET], polyamides [e.g. nylons] and/or non-hydrocarbon polymers; more usefully comprise one or more polymers selected from: High Density Polyethylene (HDPE), polypropylene (PP), and/or polyethylene terephthalate (PET); most usefully comprise PP, for example consist of PP.

The constituent polymers in a geogrid and/or layers thereof (if the geogrid is a laminate) may be oriented, blown, shrunk, stretched, cast, extruded, co-extruded and/or comprise any suitable mixtures and/or combinations thereof. Polymers that comprise the geogrid may optionally be crosslinked by any suitable means such as electron beam (EB) or UV crosslinking, if necessary by use of suitable additives.

Polymeric resins used to produce geogrids of and/or used in the present invention are generally commercially available in pellet form and may be melt blended or mechanically mixed by well-known methods known in the art, using commercially available equipment including tumblers, mixers and/or blenders. The resins may have other additional resins blended therewith along with well-known additives such as processing aids and/or colorants. Methods for producing polymer sheets are well-known, for example to produce a polymeric sheet from which a geogrid mesh may be produced, the resins and optional additives may be introduced into an extruder where the resins may be melt plastified by heating and then transferred to an extrusion die for formation into a sheet. Extrusion and die temperatures will generally depend upon the particular resin being processed and suitable temperature ranges are generally known in the art or provided in technical bulletins made available by resin manufacturers. Processing temperatures may vary depending upon process parameters chosen.

A polymeric sheet used to prepare a geogrid of and/or used in the present invention may be oriented by stretching at a suitable temperature. The resultant oriented sheet may exhibit greatly improved properties. Orientation may be along one axis if the sheet is stretched in only one direction (uniaxial or uniax), or may be biaxial (biax) if the sheet is stretched in each of two mutually perpendicular directions in the plane of the sheet. A biaxial oriented sheet may be balanced or unbalanced, where an unbalanced sheet has a higher degree of orientation in a preferred direction. Conventionally the longitudinal direction (LD) is the direction in which the sheet passes through the machine (also known as the machine direction or MD) and the transverse direction (TD) is perpendicular to MD. Preferred biaxial sheets are oriented in both MD and TD.

The terms 'effective', 'acceptable' 'active' and/or 'suitable' (for example with reference to one or more of any process, use, method, application, product, material, structure, construction, composition, component, ingredient, and/or polymer described herein of and/or used in the present invention as appropriate) will be understood to refer to those features of the invention which if used in the correct manner provide the required properties to that which they are added and/or incorporated to be of utility as described herein. Such utility may be direct for example where a moiety has the required properties for the aforementioned uses and/or indirect for example where a moiety has use as an intermediate and/or other tool in preparing another moiety of direct utility. As used herein these terms also denote that sub-entity of a whole (such as a component and/or ingredient) is compatible with producing effective, acceptable, active and/or suitable end geogrids and/or constructions as described herein.

Preferred utility of the present invention comprises use of geogrid to prepare a railway geoengineering construction for a track, (usefully a railway geoengineering construction of the present invention) to increase the Rayleigh wave velocity and/or critical track velocity, compared to the same construction without a geogrid therein, to be at least 10% above, more preferably at least 15% above, even more preferably at least 20% above, most preferably at least 25% above and for example at least 33% above the maximum speed (TSL or Vtmax) at which trains would be allowed to travel along the track.

Conveniently another utility of the present invention comprises use of geogrid to prepare a railway geoengineering construction for a track, (usefully a railway geoengineering construction of the present invention) to increase the Rayleigh wave velocity and/or critical track velocity, compared to the same construction without a geogrid therein, to be at least 140 $ms^{-1}$ (~310 mph or ~500 kph); more preferably at least 150 $ms^{-1}$ (~335 mph or ~540 kph); even more preferably at least 160 $ms^{-1}$ (~360 mph or ~570 kph); (such as ≥167 $ms^{-1}$ (~375 mph or ~600 kph)), most preferably at least 170 $ms^{-1}$ (~380 mph or −610 kph), for example at least 180 $ms^{-1}$ (~400 mph or ~650 kph) (e.g. ≥185 $ms^{-1}$ (~410 mph or ~660 kph)).

Unless the context clearly indicates otherwise, as used herein plural forms of the terms herein are to be construed as including the singular form and vice versa.

The term "comprising" as used herein will be understood to mean that the list following is non exhaustive and may or may not include any other additional suitable items, for example one or more further feature(s), component(s), ingredient(s) and/or substituent(s) as appropriate.

In the discussion of the invention herein, unless stated to the contrary, the disclosure of alternative values for the upper and lower limit of the permitted range of a parameter coupled with an indicated that one of said values is more preferred than the other, is to be construed as an implied statement that each intermediate value of said parameter, lying between the more preferred and less preferred of said alternatives is itself preferred to said less preferred value and also to each less preferred value and said intermediate value.

For all upper and/or lower boundaries of any parameters given herein, the boundary value is included in the value for each parameter. It will also be understood that all combinations of preferred and/or intermediate minimum and maximum boundary values of the parameters described herein in various embodiments of the invention may also be used to define alternative ranges for each parameter for various other embodiments and/or preferences of the invention whether or not the combination of such values has been specifically disclosed herein.

It will be understood that the total sum of any quantities expressed herein as percentages cannot (allowing for rounding errors) exceed 100%. For example the sum of all components of which the composition of the invention (or part(s) thereof) comprises may, when expressed as a weight (or other) percentage of the composition (or the same part(s) thereof), total 100% allowing for rounding errors. However where a list of components is non exhaustive the sum of the percentage for each of such components may be less than 100% to allow a certain percentage for additional amount(s) of any additional component(s) that may not be explicitly described herein.

The term "substantially" as used herein may refer to a quantity or entity to imply a large amount or proportion thereof. Where it is relevant in the context in which it is used "substantially" can be understood to mean quantitatively (in relation to whatever quantity or entity to which it refers in the context of the description) there comprises a proportion of at least 80%, preferably at least 85%, more preferably at least 90%, most preferably at least 95%, especially at least 98%, for example about 100% of the relevant whole. By analogy the term "substantially-free" may similarly denote that quantity or entity to which it refers comprises no more than 20%, preferably no more than 15%, more preferably no more than 10%, most preferably no more than 5%, especially no more than 2%, for example about 0% of the relevant whole.

Geogrids and/or constructions of and/or used in the present invention (and/or any components thereof) may also exhibit improved properties with respect to known geogrids that are used in a similar manner. Such improved properties may be in at least one, preferably a plurality, more preferably three of more of those propert(ies) described herein as preferred and/or by similar terminology. Preferred geogrids and/or constructions of and/or used in the present invention, may exhibit comparable properties (compared to known compositions and/or components thereof) in two or more, preferably three or more, most preferably in the rest of those properties described herein as preferred or similar.

Improved properties as used herein means the value of the component, geogrid and/or construction of and/or used in the present invention is >+8% of the value of the known reference component, geogrid and/or construction that may be described herein, more preferably >+10%, even more preferably >+12%, most preferably >+15%.

Comparable properties as used herein means the value of the component, geogrid and/or construction of and/or used in the present invention is within +/−6% of the value of the known reference component, geogrid and/or construction that may described herein, more preferably +/−5%, most preferably +/−4%.

The percentage differences for improved and comparable properties herein refer to fractional differences between the component, geogrid and/or construction of and/or used in the invention and a known reference component, geogrid and/or construction that may be described herein where the property is measured in the same units in the same way (i.e. if the value to be compared is also measured as a percentage it does not denote an absolute difference).

Unless otherwise indicated all the tests herein are carried out under standard conditions as also defined herein.

As used herein, unless the context indicates otherwise, standard conditions means, atmospheric pressure, a relative humidity of 50%±5%, ambient temperature (22° C.±2°) and an air flow of less than or equal to 0.1 m/s. Unless otherwise indicated all the tests herein are carried out under standard conditions as defined herein.

BRIEF DESCRIPTION OF THE DRAWINGS

The invention is illustrated by the following non-limiting FIGS. 1 to 5 where.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

It should be noted that embodiments and features described in the context of one of the aspects or embodiments of the present invention also apply to the other aspects of the invention whether or not such features are stated as preferred or similar terminology. Although embodiments have been disclosed in the description with reference to specific examples, it will be recognized that the invention is not limited to those embodiments. All intermediate generalizations between the broadest scope of the invention described herein and each of the embodiments and/or examples described herein are thus envisaged as comprising the present invention. Combinations and/or mixtures of any features described in one embodiment of the invention may be applied to any other embodiments of the invention whether by analogy or otherwise and are envisaged as comprising the present invention. Various modifications may become apparent to those of ordinary skill in the art and may be acquired from practice of the invention and such variations are contemplated within the broad scope of protection for the present invention as allowed under applicable local law even if the variant may be outside the literal meaning of the claims. It will be understood that the materials used and the details may be slightly different or modified from the descriptions without departing from the methods and compositions disclosed and taught by the present invention.

Further aspects of the invention and preferred features thereof are given in the claims herein.

Examples 1 (TX150), 2 (TX130S), 3 (TX170) and 4 (TX190L) and Comps A to C

The present invention will now be described in detail with reference to the following non limiting examples which are by way of illustration only.

Figure 6:
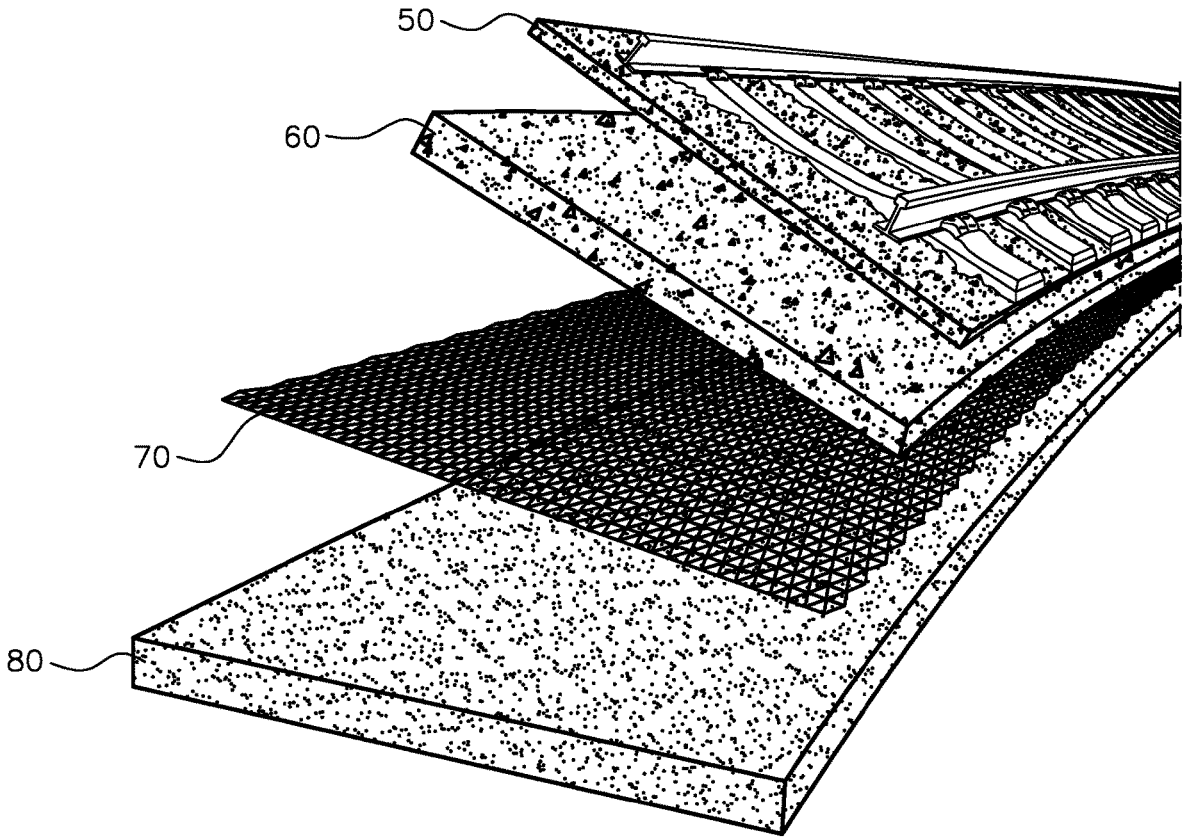
FIG. 6 provides an exploded view of the various structural elements of the geogrid engineering construction according to one embodiment of the invention, including the location of the geogrid element within the construction.

FIG. 6 provides an exploded view of the various structural elements of the geogrid engineering construction according to one embodiment of the invention, including the location of the geogrid element 70 within the construction. For example, the geogrid engineering construction can include, according one embodiment, a railway track bed 50, a granular fill 60, a geogrid 70, and a subgrade 80.

Without wishing to be bound by any theory the applicant believes that the velocity of the waves generated in a track sub layer may be related to stiffness of the underlying material beneath the track (i.e. ground, typically soil), with the depth of wave penetration increasing with reducing frequency and increasing wavelength (λ). Waves of high frequency travel only in shallow layers. Waves of lower frequency travel both in shallow and deep layers. Wave velocity through the ground will therefore vary with frequency and depth a phenomenon commonly known as geometrical dispersion. It is believed that the contribution of the P-wave component to the inherent Raleigh wave velocity (Vr) is small compared to the contribution from the S-wave component. The S-wave velocity (Vs) may thus be used to determine ground stiffness, especially where the ground exhibits substantially elastic behaviour. In one embodiment of the invention the applicant has found Vr may be derived from Vs for example using Equation 1A to a first approximation:

$$V_r \cong \left(\frac{0.874 + 1.117\nu}{1 + \nu}\right)V_s, \qquad \text{Equation 1A}$$

where

Vr is the Rayleigh Wave velocity through the ground;

Vs is the velocity of S-waves through the ground; and

υ is the Poisson ratio (the signed ratio of transverse strain to axial strain).

The velocity profile of the S-waves may be converted to a small strain shear modulus ($G_0$) using the simple relationship with ground density defined in Equation 2. Given the nature of the relationship with, and limited variance of, ground density (e.g. if soil), the derivation of $G_0$ is relatively insensitive to assumed ground density if not known.

$$G_0 = \rho(V_s)^2 \qquad \text{Equation 2, where}$$

$G_0$ the small strain stiffness property; and

ρ is density of the ground.

The stiffness represents an approximate average stiffness for a given depth of ground. If the ground is soil, then as soil density typically varies between 1.6 $Mg/m^3$ and 2.1 $Mg/m^3$ for most ground conditions (24% variation), derivation of Go is therefore relatively insensitive to assumed soil density (if not known), and the conservative (i.e. lower bound) of soil density is assumed.

Go may be converted to Young's Modulus (E) using the relationship $E=G\cdot(2\cdot(1+\upsilon))$. Unlike shear stiffness, E is affected by the stiffness of the soil pore water with Poisson's Ratio, varying between 0.2 (fully drained) and 0.5 (for undrained saturated soils). Selection of an appropriate Poisson's Ratio value is therefore important in determining a representative E value for the prevailing drainage conditions. For drained conditions Poisson's Ratio is generally in the range 0.2-0.35 which results in a 32% range of calculated E values. If Poisson's Ratio is not known, then the conservative (low) values may be selected, generating lower values of stiffness. A default typical lower-bound soil density of 1.80 $Mg/m^3$ and typical drained Poisson's Ratio of 0.26 may be used where no site specific information is provided. These values may be adjusted where site specific values have been determined or to reflect undrained drainage conditions in saturated soils.

Stiffness values obtained by testing in the examples described herein are small-strain stiffness values relevant to strain levels below approximately 0.002%. In the examples site testing was carried out using the following Seismic sources and array geophones. Standard Shaker—GSS Standard 80 kg Shaker—10 to 91 Hz; and EM Shaker—GSS Electromagnetic Shaker—50 to 400 Hz. The tests were carried out on a trial embankment 2.0 m high and 40 m long. The embankment used as the fill material granular limestone that complied with UK Specification for Highway works (SHW) 6F1 taken from a quarry stockpile. The embankment was divided into 5 zones each 6 m wide and 2 m deep as shown in Table 1 below.

TABLE 1

| | Control (Comp C) | Zone (Ex 1) | Zone 2 (Ex 2) | Zone 3 (Ex 3) | Zone 4 (Ex 4) |
|---|---|---|---|---|---|
| Geogrid | None (non-stabilized) | TX150 | TX130S | TX170 | TX190L |

Figure 1:
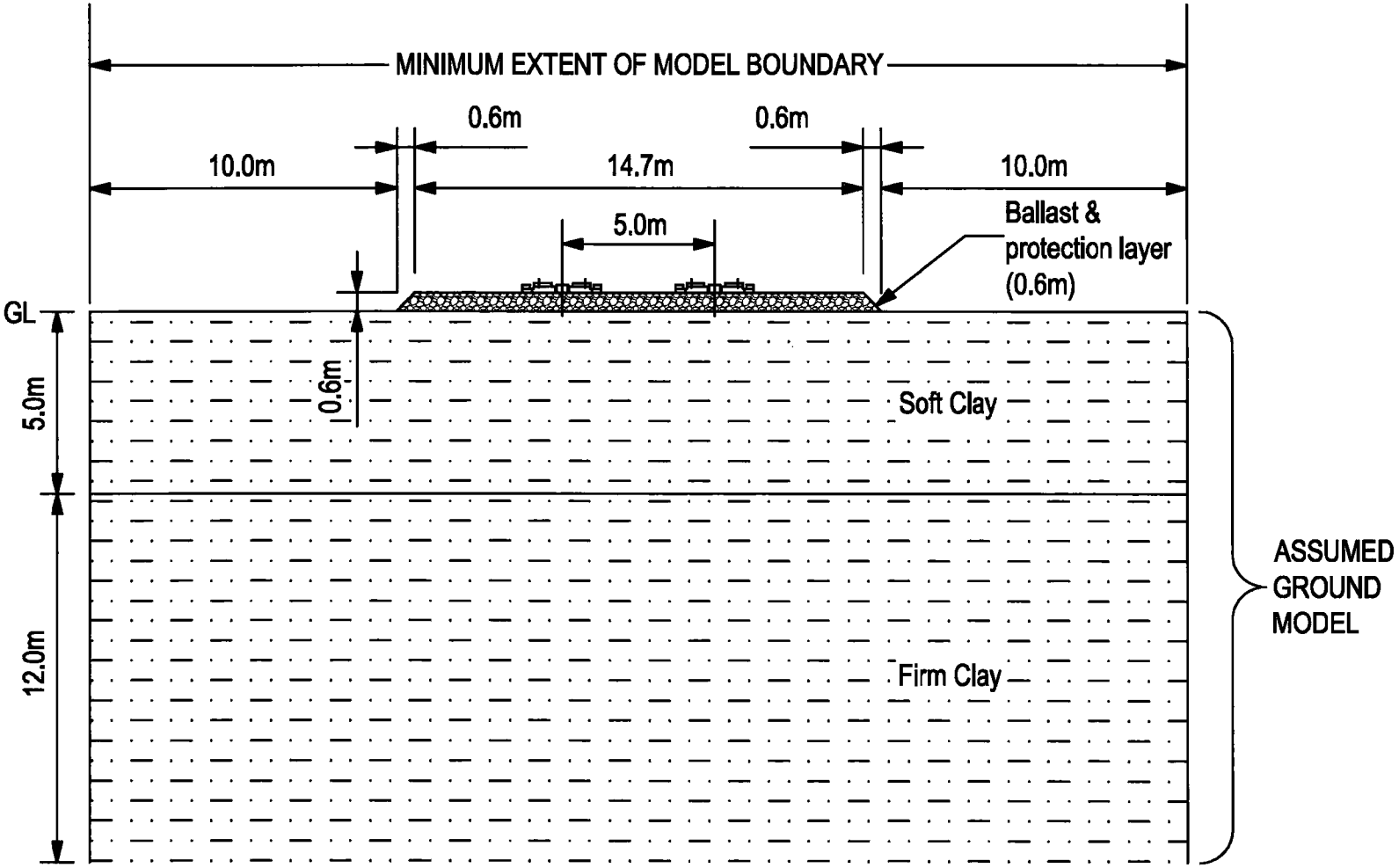
FIG. 1 shows a railway track construction over untreated ground (denoted Comp A)
Figure 2:
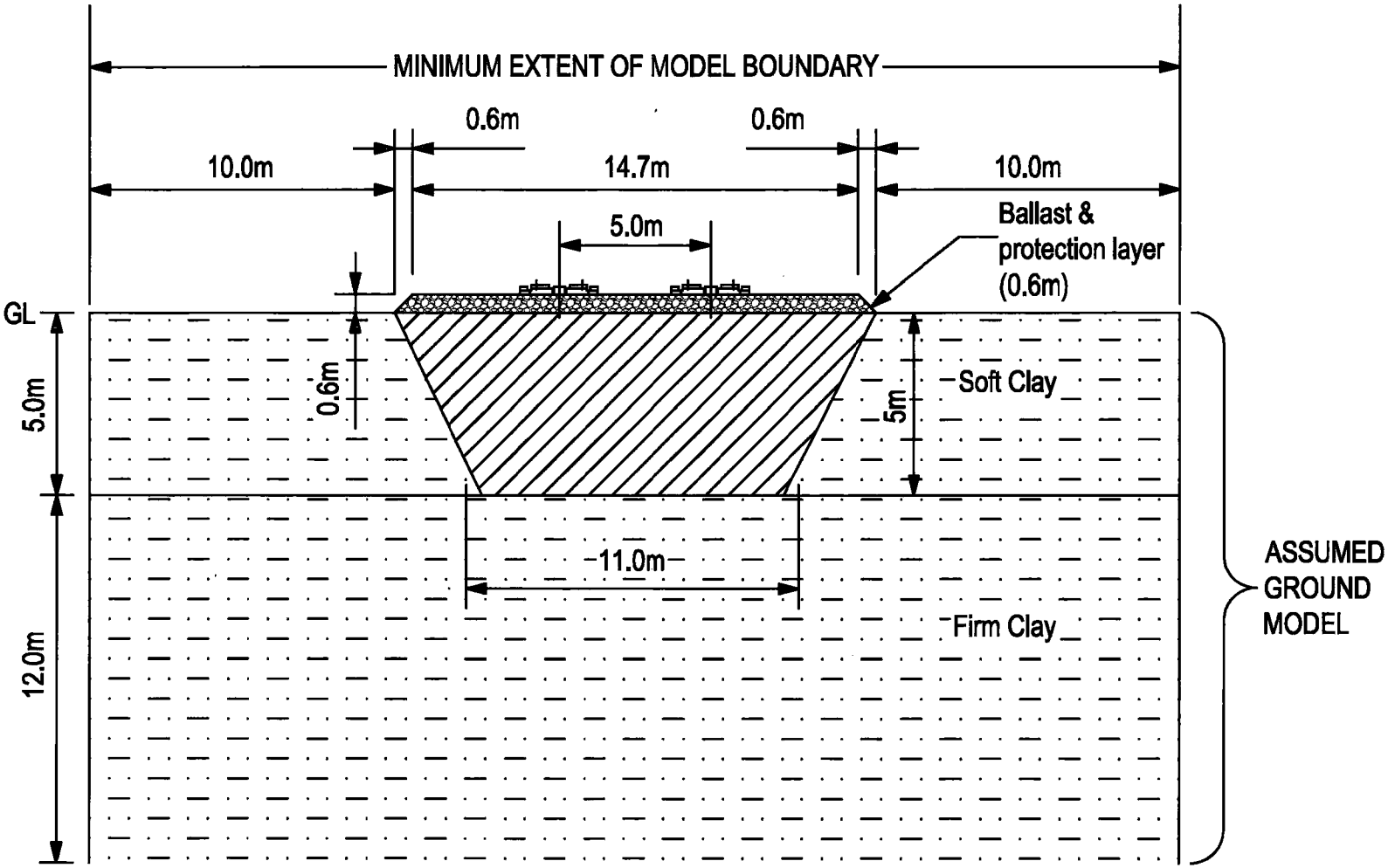
FIG. 2 shows a railway track construction that uses a granular replacement of underlying material to 5 m depth (denoted Comp B) which is a currently proposed method of constructing high speed train lines.
Figure 3:
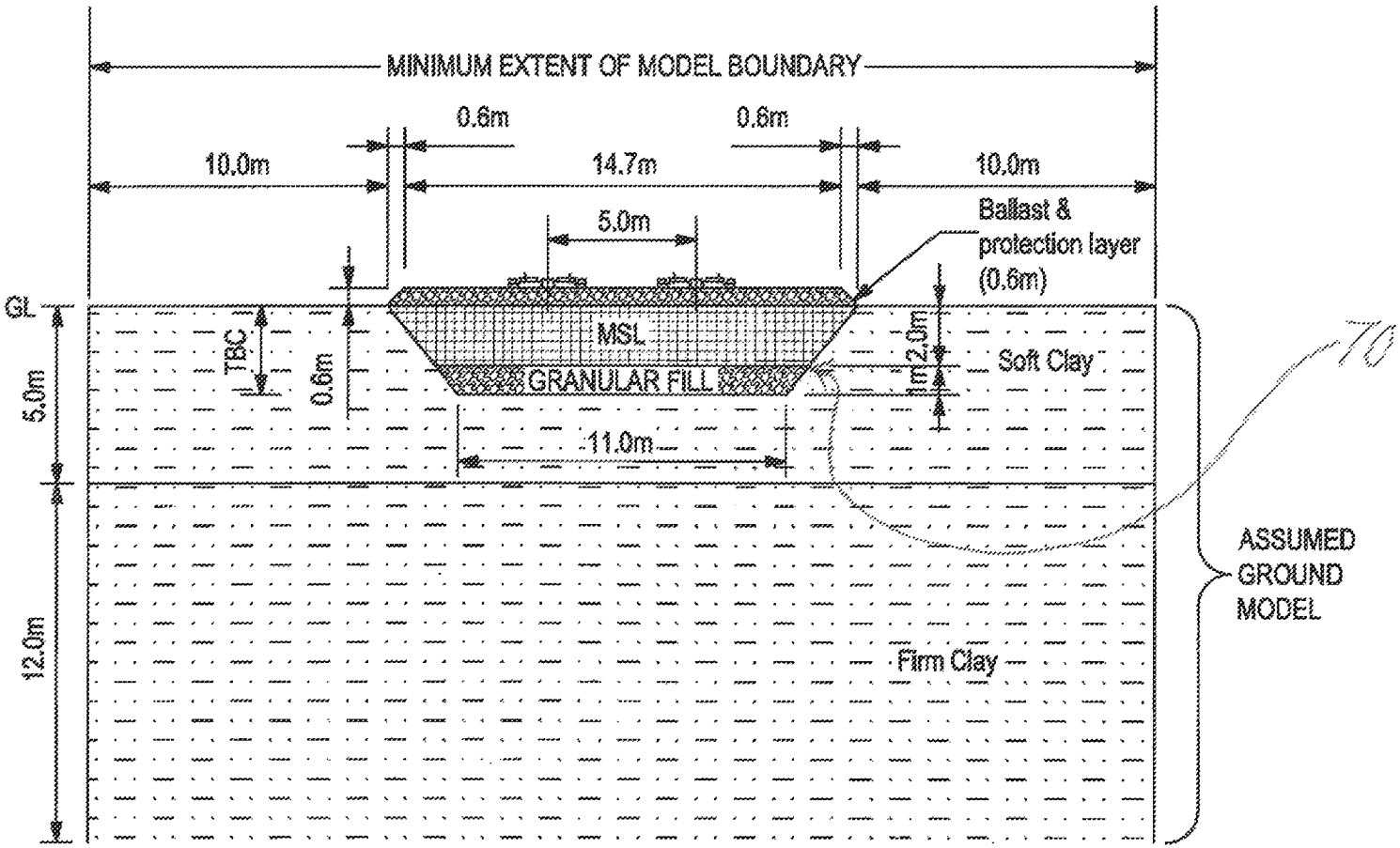
FIG. 3 shows a railway track construction using layering and with a geogrid mechanically stabilized layer (MSL) with granular fill (as used in Test Examples 1 to 4 described herein). The construction shown in FIG. 3 was used in a 3D numerical model to calculate speed of shear wave through the ground for a given stiffness and depth of construction given in FIGS. 4 and 5.
Figure 7:
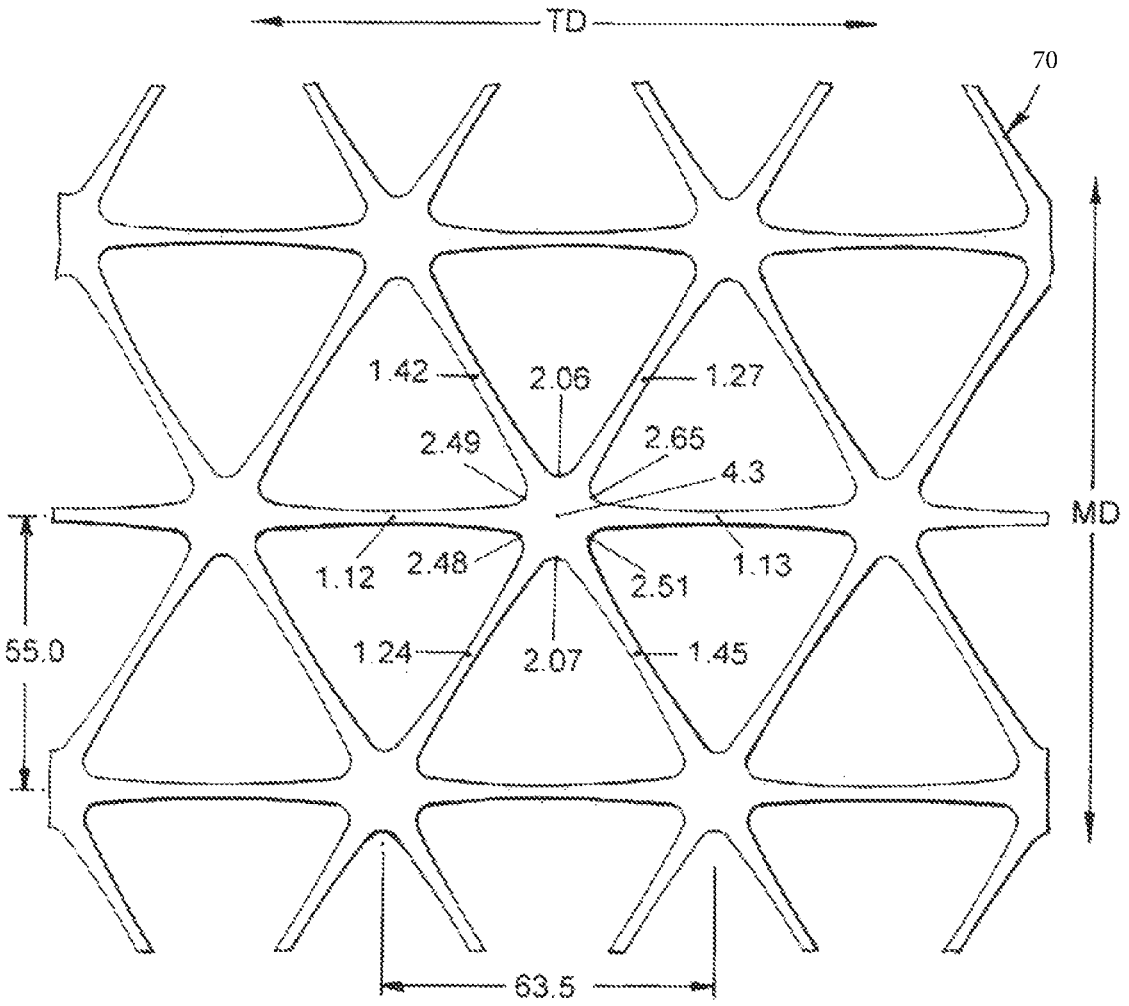
FIG. 7 provides an enlarged view of the various structural elements of the geogrid element shown in FIG. 6.

Comp A and Comp B are shown in respective FIGS. 1 and 2 and represent prior art railway geoengineering constructions without (Comp A) and with (Comp B) a geogrid. The Examples 1 to 4 and Comp C from Table 1 used in these tests were constructed as shown in FIG. 3 with the geogrid 70 located in a horizontal plane immediately below the layer labelled MSL and above that marked granular fill. The geogrids 70 used were those respective geogrid products available commercially from Tensar International Limited under the registered trade mark TriAx® together with the trade designations given in Table 1 except for Comp C where the same construction without any geogrid was used. See, for example, such a geogrid 70 as depicted in application FIG. 7, according to one embodiment of the instant invention. FIG. 7 provides an enlarged view of the various structural elements of the geogrid 70.

To verify that a similar degree of compaction was achieved in the embankment test sections, Nuclear Density Meter (NDM) tests (calibrated for the specific fill used) were carried out on the embankment together with a calibration test for the fill material. The NDM tests were carried out in the top 200 mm of the test embankment only and in-situ density and the moisture content obtained from these tests is summarised in Table 2

TABLE 2

| | Bulk Density ($Mg/m^3$) | | Moisture Content %[b] | |
|---|---|---|---|---|
| Ex | Average[a] | Range | Average[a] | Range |
| Comp C | 2.27 | 2.23 to 2.28 | 6.3 | 6.0 to 6.5 |
| Ex 1 | 2.29 | 2.24 to 2.34 | 6.3 | 6.0 to 6.7 |
| Ex 2 | 2.25 | 2.18 to 2.29 | 6.4 | 6.0 to 6.9 |
| Ex 3 | 2.26 | 2.17 to 2.31 | 6.4 | 5.9 to 6.7 |
| Ex 4 | 2.25 | 2.23 to 2.27 | 6.4 | 5.8 to 6.8 |

[a]Average of 6 tests carried out per zone.
[b]Moisture content undertaken in the laboratory on collected bulk samples It was observed that the ground beneath the test embankment contained quarry waste having particulate material of various sizes (fine grained soil to boulder size grains) and thus was loosely compacted. The tests were performed twice on the same test embankment at different times a few months apart. The first test was performed in rainy and damp conditions and the second test in dry and bright conditions with a strong wind. The soil below the control zone (Comp C) and the zone of Ex 1 was observed to be particularly wet in comparison to the rest of the embankment during the first test. The measurements in each test zone were taken in both a longitudinal direction (see FIG. 4) and laterally across the embankment (see FIG. 5) with reverse-direction measurements also being taken.

Figure 4:
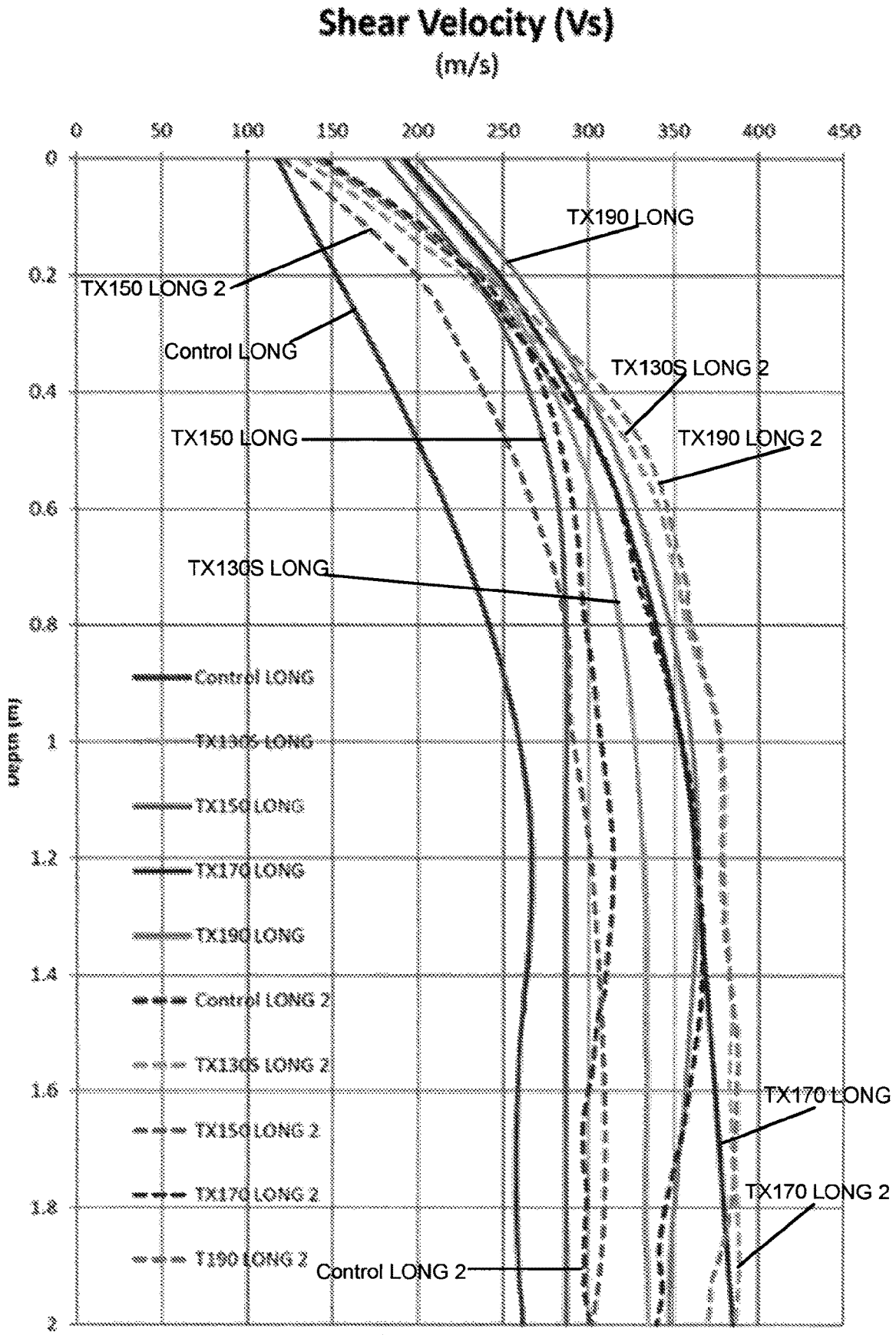
FIG. 4 shows Shear velocity at 0.002% Strain for longitudinal (parallel with embankment length) CSW testing (suffix 2 indicates testing in the Second Test)
Figure 5:
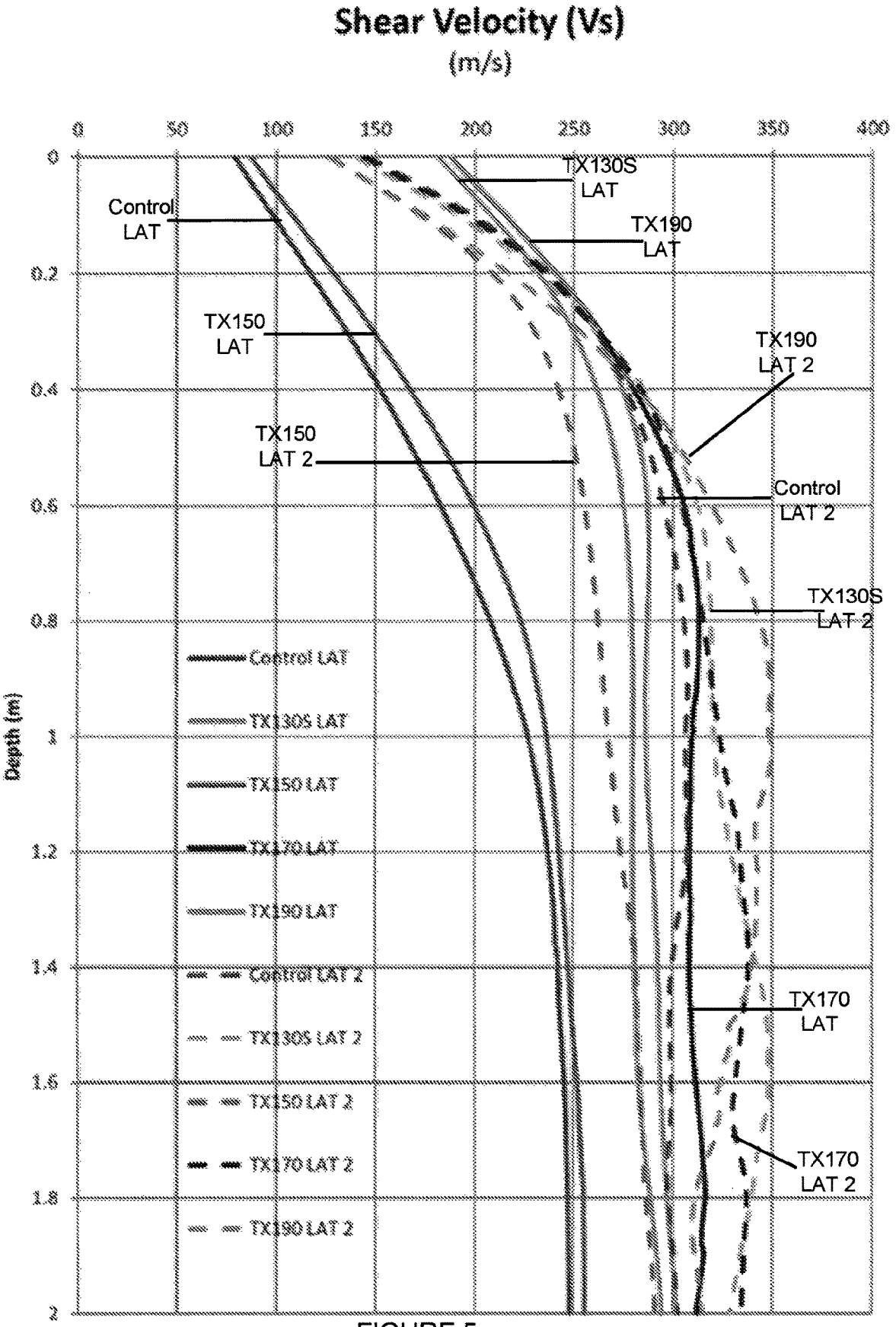
FIG. 5 shows Shear velocity at 0.002% Strain for lateral (perpendicular to embankment length) CSW testing (suffix 2 indicates testing in the Second Test).

Dispersion curves were plotted in FIGS. 4 to 5 showing the shear wave velocity (Vs) along the longitudinal axis of the embankment (FIG. 4) and also Vs along its width (FIG. 5). These curves were calculated using Equation 1A above from the trial data, assuming Poisson ratio ($\upsilon$) of 0.26 for the embankment material. The range of the combined frequencies of the two seismic sources used in these tests was from 10 Hz to 400 Hz. The penetration depth was directly dependent on characteristics of the source frequency and predominantly on velocity of the S-waves (Vs) in the embankment medium. For example, where the average velocity of the S-waves generated in a test embankment is about 200 m/s, then a 10 Hz component of a corresponding Rayleigh wave generated in the embankment would penetrate to a depth of from about 7 to about 10 m below ground level and a 400 Hz component of the corresponding Rayleigh wave would penetrate the embankment to a depth of from about 0.2 to about 0.3 m below ground level.

Corresponding Rayleigh wave denotes a Rayleigh wave that when generated in the embankment (e.g. by movement of a train along the track) would comprise a S-wave component equivalent to the S waves induced in the embankment in these tests by the seismic sources (and recorded by the array geophones) as previously described. For completeness, profiles of Vs were calculated using test data in the models described herein to a depth of 15 m below ground level. However as the depth of the test embankment was only 2.0 m below ground level the Vs values presented in FIGS. 4 and 5 are those calculated for the top 2 m only.

Results

The results obtained from second test show reduced shear velocity (Vs) near the surface (to about 0.4 to 0.5 m) compared to those of the first test. This is believed to be due to weathering leading to strain-softening in the near two-month interval between the two tests, whereas in practise this particulate material would be covered by some 600 mm of construction in use and would not be exposed in such a way. The longitudinal stiffness (from FIG. 4) for both the control and the test embankments was greater than the lateral stiffness (from FIG. 5) by about 25%. This is believed to be due to the test embankment being less restrained across its width compared to its length. Both these effects are artefacts of the trial and would be unlikely to be encountered in real world railway tracks constructed for practical use and so these differences are not considered especially relevant.

Example 1 (TX150) provided an acceptable, though lower, increase in stiffness of the embankment for both tests.

Example 2 (TX130S) had a similar effect to Ex 3 (TX170) at the top of the layer.

Example 3 (TX170) increased the longitudinal stiffness of the embankment by between 20% and 60%.

Example 4 (TX190L) which used the stiffest of the geogrids used showed the most improvement in longitudinal stiffness of between 30% and 70%.

Example 5 (TX150L), which is a slightly thicker version of Example 1, also provides an acceptable increase in stiffness of the embankment, generating similar results to those given herein for Examples 1 to 4 in the tests describe herein.

Required certification for stabilization function is ETA 12/0530

TABLE 3a

Performance related physical properties of the products

| Product Characteristic | Unit | Ex (product) | Declared Value | Tolerance |
|---|---|---|---|---|
| Radial Secant (1) Stiffness at 0.5% strain | kN/m | 1 (TX150) | 360 | −65 |
| | | 2 (TX130S) | 275 | −75 |
| | | 3 (TX170) | 480 | −90 |
| | | 4 (TX190L) | 540 | −90 |
| | | 5 (TX150L) | 365 | −90 |
| Radial Secant Stiffness Ratio (1) | — | 1 (TX150) | 0.80 | −0.15 |
| | | 2 (TX130S) | 0.75 | −0.15 |
| | | 3 (TX170) | 0.80 | −0.15 |
| | | 4 (TX190L) | 0.75 | −0.15 |
| | | 5 (TX150L) | 0.75 | −0.15 |

TABLE 3b

Performance related physical properties of the products (continued)

| Product Characteristic | Unit | Ex (product) | Declared Value | Tolerance |
|---|---|---|---|---|
| Junction Efficiency (2) | % | 1 (TX150) | 100 | −10 |
| | | 2 (TX130S) | 100 | −10 |
| | | 3 (TX170) | 100 | −10 |
| | | 4 (TX190L) | 100 | −10 |
| | | 5 (TX150L) | 100 | −10 |
| Hexagon Pitch (3) | mm | 1 (TX150) | 80 | ±4 |
| | | 2 (TX130S) | 66 | ±4 |
| | | 3 (TX170) | 80 | ±4 |
| | | 4 (TX190L) | 120 | ±6 |
| | | 5 (TX150L) | 120 | ±6 |

TABLE 4

Properties for identification of the products

| Product Characteristic | Unit | Ex (Product) | Declared Value | Tolerance |
|---|---|---|---|---|
| Radial Secant Stiffness (1) at 2% strain | kN/m | 1 (TX150) | 250 | −65 |
| | | 2 (TX130S) | 205 | −65 |
| | | 3 (TX170) | 360 | −65 |
| | | 4 (TX190L) | 400 | −100 |
| | | 5 (TX150L) | 290 | −100 |
| Hexagon Pitch (3) | mm | 1 (TX150) | 80 | ±4 |
| | | 2 (TX130S) | 66 | ±4 |
| | | 3 (TX170) | 80 | ±4 |
| | | 4 (TX190L) | 120 | ±6 |
| | | 4 (TX150L) | 120 | ±6 |
| Weight of the product (4) | $kg/m^2$ | 1 (TX150) | 0.205 | −0.035 |
| | | 2 (TX130S) | 0.180 | −0.030 |
| | | 3 (TX170) | 0.270 | −0.035 |
| | | 4 (TX190L) | 0.300 | −0.035 |
| | | 5 (TX150L) | 0.240 | −0.035 |

Notes for Tables 3a, 3b and 4 (Ex 1 to 5)

(1) Measured in accordance with EOTA Technical report TR41 B.1.

(2) Measured in accordance with EOTA Technical report TR41 B.2.

(3) Measured in accordance with EOTA Technical report TR41 B.4.

(4) Measured in accordance with EOTA Technical report TR41 B.3.

Durability Statement (5,6 &7) The minimum working life of the geogrid in natural soils with a pH value between 4 and 9 is assumed to be 100 years in soil temperatures less than 15° C. and expected to be 50 years in soil temperatures less than 25° C., when covered within 30 days.

(5) Resistance to weathering of geogrid assessed in accordance with EN 12224. The retained strength is greater than 80% giving a maximum time for exposure after installation of 1 month.

(6) Resistance to Oxidation is determined in accordance with EN ISO 13438. For the assumed working life of 50 years, the principle of Method A2 of EN ISO 12438 is followed, with the deviation that the exposure temperature is 120° C. and the exposure time 28 days. Justification for this is provided in ETA Certificate 12/0530.

(7) Resistance to acid and alkali liquids is determined in accordance with EN 14030.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A geogrid engineering construction for railways, the construction comprising:

a track bed which defines a track located on a track plane;

a particulate layer lying beneath the track plane; and a geogrid located in and/or adjacent to the particulate layer, where the geogrid is located in a geogrid plane substantially parallel to the track plane such that the geogrid stabilizes the particulate layer such that the properties of the particulate layer satisfy Equation 4A;

$$55 \geq \left(\frac{A + B\nu}{1 + \nu}\right)\sqrt{\frac{G_0}{\rho}} \qquad \text{Equation 4A}$$

where

A is a dimensionless constant;

B is a dimensionless constant;

$\upsilon$ denotes the Poisson ratio of the particulate layer;

$G_0$ is the small strain stiffness property of the particulate layer; and $\rho$ is density of the particulate layer.

2. The geogrid engineering construction for railways of claim 1, wherein the track bed comprises rails.

3. The geogrid engineering construction for railways of claim 1, wherein $\upsilon$ is from 0.1 to 0.5.

4. The geogrid engineering construction for railways of claim 1, wherein $\upsilon$ is from 0.2 to 0.4.

5. The geogrid engineering construction for railways of claim 1, wherein $\upsilon$ is from 0.2 to 0.35.

6. The geogrid engineering construction for railways of claim 1, wherein the average distance between the track plane and geogrid plane, measured perpendicular to both, and denoted herein as Dr, is greater than 0.65 metres.

7. A method for constructing a geogrid engineering construction for railways, the method of construction comprising:

defining a track plane along which the track bed will be located;

providing an particulate layer beneath the track plane with a geogrid located in and/or adjacent to the particulate layer, where the geogrid is located in geogrid plane substantially parallel to the track plane such that the geogrid stabilizes the particulate layer such that the properties of the particulate layer satisfy Equation 4A;

$$55 \geq \left(\frac{A + Bv}{1 + v}\right)\sqrt{\frac{G_0}{\rho}} \quad \text{Equation 4A}$$

where

A is a dimensionless constant;

B is a dimensionless constant;

υ denotes the Poisson ratio of the particulate layer;

$G_0$ is the small strain stiffness property of the particulate layer; and

ρ is density of the particulate layer.

8. The method of claim 7, wherein the track bed comprises rails.

9. The method of claim 7, wherein υ is from 0.1 to 0.5.

10. The method of claim 7, wherein υ is from 0.2 to 0.4.

11. The method of claim 7, wherein υ is from 0.2 to 0.35.

12. The method of claim 7, wherein the average distance between the track plane and geogrid plane, measured perpendicular to both, and denoted herein as Dr, is greater than 0.65 metres.

13. A particulate material stiffened and/or strengthened by the method of claim 7.

14. Use of a geogrid in a method to construct a geogrid engineering construction for railways comprising:

defining a track plane along which the track bed will be located;

defining a particulate layer lying beneath the track plane with a geogrid located in and/or adjacent to the particulate layer, the geogrid being located in a geogrid plane substantially parallel to the track plane such plane being defined such that the geogrid is calculated to stabilize the particulate layer such that the properties of the particulate layer satisfy Equation 4A;

$$55 \geq \left(\frac{A + Bv}{1 + v}\right)\sqrt{\frac{G_0}{\rho}} \quad \text{Equation 4A}$$

where

A is a dimensionless constant;

B is a dimensionless constant;

υ denotes the Poisson ratio of the particulate layer;

$G_0$ is the small strain stiffness property of the particulate layer; and

ρ is density of the particulate layer.

15. The use of claim 14, wherein the track bed comprises rails.

16. The use of claim 14, wherein υ is from 0.1 to 0.5.

17. The use of claim 14, wherein υ is from 0.2 to 0.4.

18. The use of claim 14, wherein υ is from 0.2 to 0.35.

19. The use of claim 14, wherein the average distance between the track plane and geogrid plane, measured perpendicular to both, and denoted herein as Dr, is greater than 0.65 metres.

* * * * *